US011441866B2

(12) United States Patent
Schmid et al.

(10) Patent No.: US 11,441,866 B2
(45) **Date of Patent: *Sep. 13, 2022**

(54) FIRE CONTROL ASSEMBLY FOR A SEMI-AUTOMATIC RIFLE

(71) Applicant: PBS LLC, Park City, UT (US)

(72) Inventors: Eric G. Schmid, Park City, UT (US); Paul T. Noonan, Boise, ID (US); Steven R. Schaefer, Maple Park, IL (US)

(73) Assignee: PBS LLC, Park City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/065,352

(22) Filed: Oct. 7, 2020

(65) Prior Publication Data

US 2021/0148666 A1 May 20, 2021

Related U.S. Application Data

(63) Continuation of application No. 16/278,840, filed on Feb. 19, 2019, now Pat. No. 10,837,729.

(51) Int. Cl.
*F41A 19/46* (2006.01)

(52) U.S. Cl.
CPC ..... *F41A 19/46* (2013.01)

(58) Field of Classification Search
CPC ..... F41A 19/46; F41A 17/46; F41A 17/52
USPC ..... 89/139, 142, 18; 42/70.01, 70.06
See application file for complete search history.

(56) References Cited

U.S. PATENT DOCUMENTS

| | | | | |
|---|---|---|---|---|
| 10,126,081 | B1 * | 11/2018 | Geissele | F41A 19/46 |
| 10,837,729 | B1 * | 11/2020 | Schmid | F41A 19/46 |
| 2010/0132541 | A1 * | 6/2010 | Hochstrate | F41A 19/46 89/142 |
| 2012/0192709 | A1 * | 8/2012 | Troy | F41A 19/33 89/132 |
| 2013/0111794 | A1 * | 5/2013 | Dionne | F41A 17/00 42/70.01 |
| 2013/0111796 | A1 * | 5/2013 | Dionne | F41A 17/00 42/70.11 |
| 2017/0299304 | A1 * | 10/2017 | Otte, Jr. | F41A 19/46 |
| 2018/0087860 | A1 * | 3/2018 | Sullivan | F41A 19/12 |
| 2020/0025486 | A1 * | 1/2020 | Zung | F41A 35/06 |

OTHER PUBLICATIONS

M4Carbine.net Forums, Safety rotates full 180 degrees, May 6-Jun. 3, 2012, Internet Publication, All (Year: 2012).*

* cited by examiner

*Primary Examiner* — Bret Hayes

(57) ABSTRACT

A fire control assembly and a method are disclosed. The fire control assembly contains a pivotable shaft containing a first end and a second end, and a first selector member removably coupled with the first end of the pivotable shaft, wherein the first selector member is movable between a first position relative to the pivotable shaft and a second position relative to the pivotable shaft, wherein the first selector member is configured to rotate the pivotable shaft from a safe position to a firing position and back to the safe position when the first selector member is in the first position relative to the pivotable shaft, wherein the first selector member is configured to prevent the pivotable shaft from rotating into the firing position when the first selector member is in the second position relative to the pivotable shaft.

9 Claims, 40 Drawing Sheets

FIRE CONTROL ASSEMBLY FOR A SEMI-AUTOMATIC RIFLE

CROSS REFERENCE TO RELATED APPLICATIONS

This application is a continuation of U.S. patent application Ser. No. 16/278,840 titled "Fire Control Assembly For A Semi-Automatic Rifle" filed Feb. 19, 2019, now issued U.S. Pat. No. 10,837,729, which is incorporated herein by reference in its entirety.

FIELD

The present invention relates to a semi-automatic rifle. More particularly, the present invention relates to a fire control assembly for a semi-automatic rifle.

BACKGROUND

FIG. 1*a* depicts a side view of a firearm 10 known in the art. The firearm 10 comprises an upper receiver 15 and a lower receiver 20. Firearm 10 also has a trigger 14 and a fire control selector or switch 25.

Referring to FIG. 1*b*, the fire control selector 25 enables the user to switch between modes of fire, such as for example, SAFE and SEMI-AUTOMATIC. Other modes, such as burst (not shown) and/or automatic (not shown), may also be provided. The user rotates the fire control selector 25 with a thumb or other finger(s) to switch between firearm modes of operation. A problem arises when a child finds an unlocked firearm 10. The child can fire from the unlocked firearm 10 even if the fire control selector 25 of the firearm 10 is in the SAFE mode by easily switching the fire control selector 25 to SEMI-AUTOMATIC mode. There is nothing in the prior art that can prevent the child from easily switching the fire control selector 25 to SEMI-AUTOMATIC mode.

There needs to be a better way of preventing a child from easily switching the fire control selector 25 of the firearm 10 to SEMI-AUTOMATIC mode or any other modes of fire.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1A:
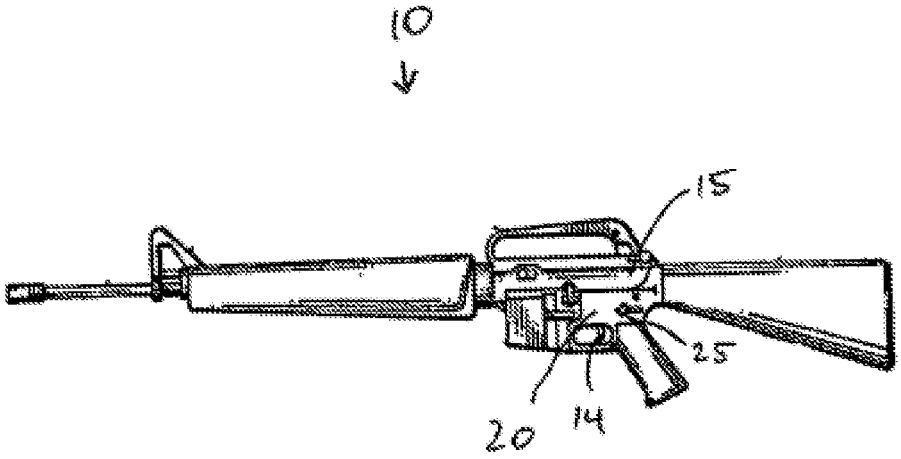
Figure 1a PRIOR ART
FIG. 1*a* depicts a firearm as known in the art.
Figure 1B:
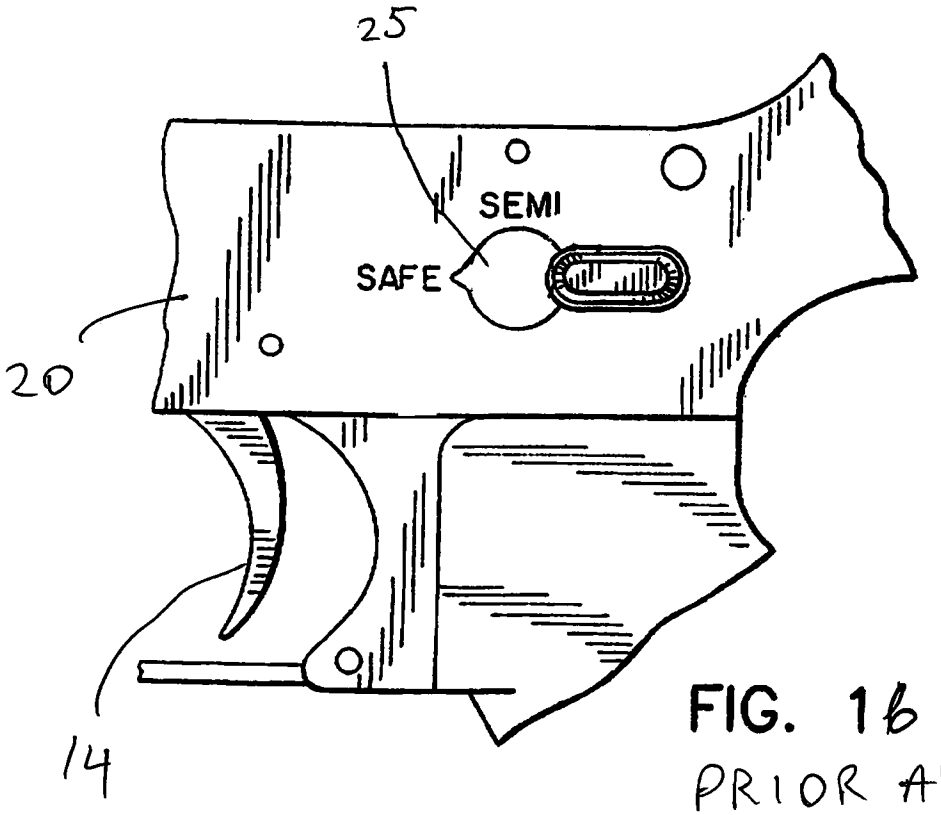
FIG. 1b PRIOR ART
FIG. 1*b* depicts a fire control selector as known in the art.
Figure 2A:
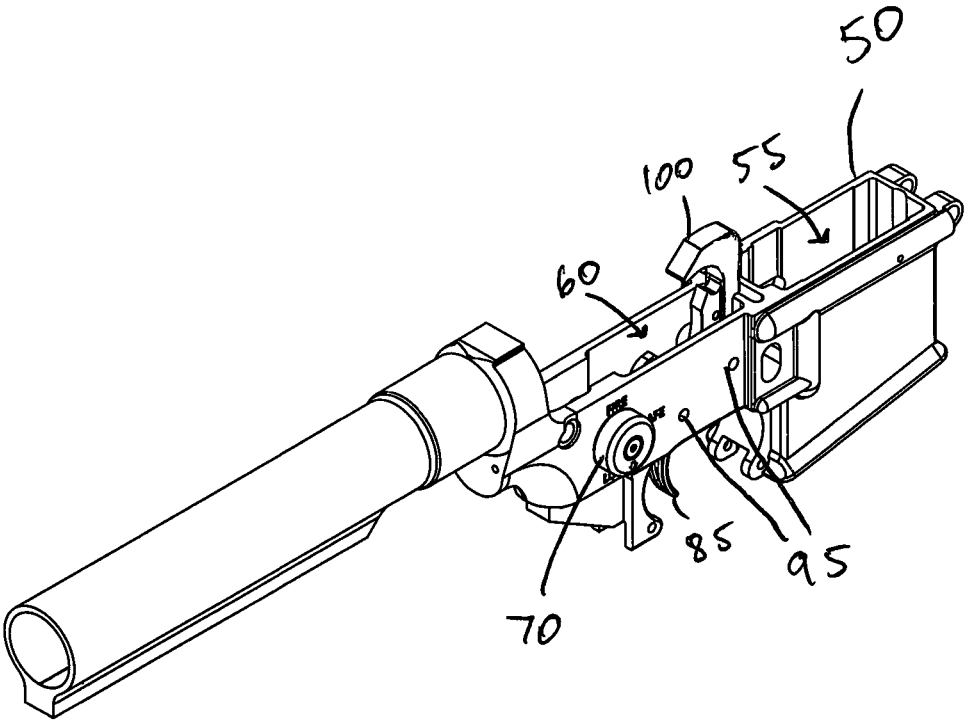
FIG. 2*a* depicts a right side of a partially assembled lower receiver according to some embodiments presently disclosed.
Figure 2B:
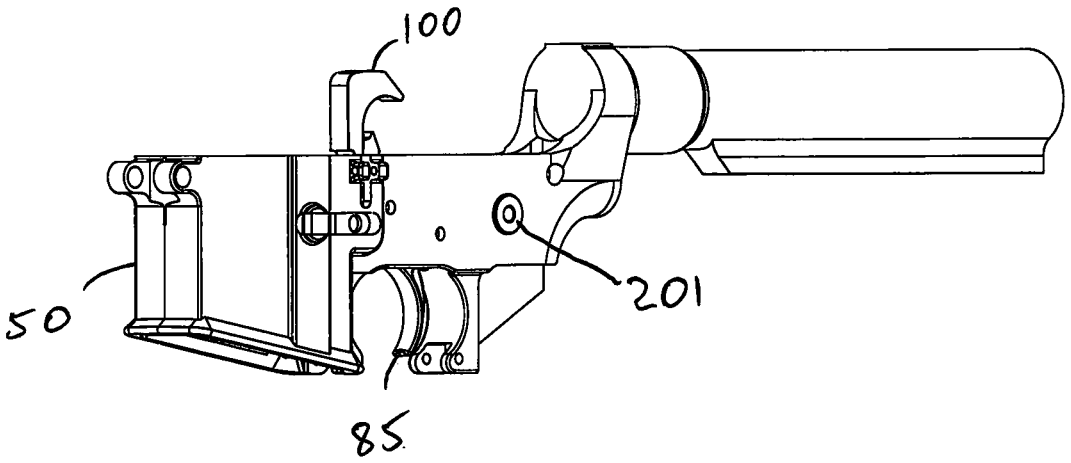
FIG. 2*b* depicts a left side of the partially assembled lower receiver shown in FIG. 2*a*.

Referring to FIGS. 2*a-b*, there is shown, a lower receiver 50 of a firearm in accordance with some embodiments presently disclosed. According to some embodiments presently disclosed, the lower receiver 50 comprises openings for accepting the internal mechanisms required to operate the firearm. For example, the lower receiver 50 may comprise a magazine well 55 adapted to receive and hold an ammunition magazine (not shown). The lower receiver 50 may also comprise an opening 60 configured to accommodate a firing mechanism 80 (shown in FIGS. 8*a-c* and described in more details below).

Figure 3A:
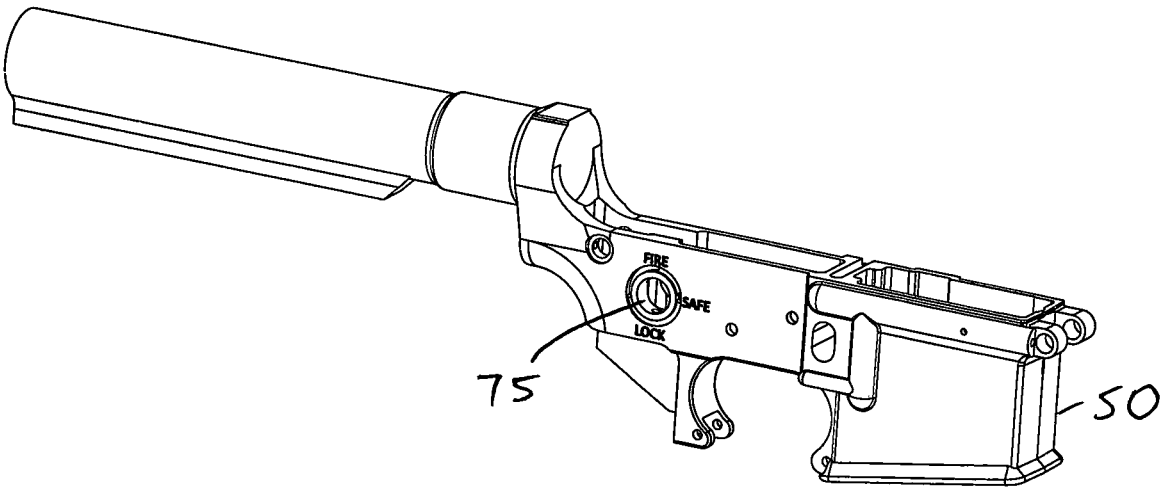
FIG. 3*a* depicts a right side of a disassembled lower receiver according to some embodiments presently disclosed.
Figure 3B:
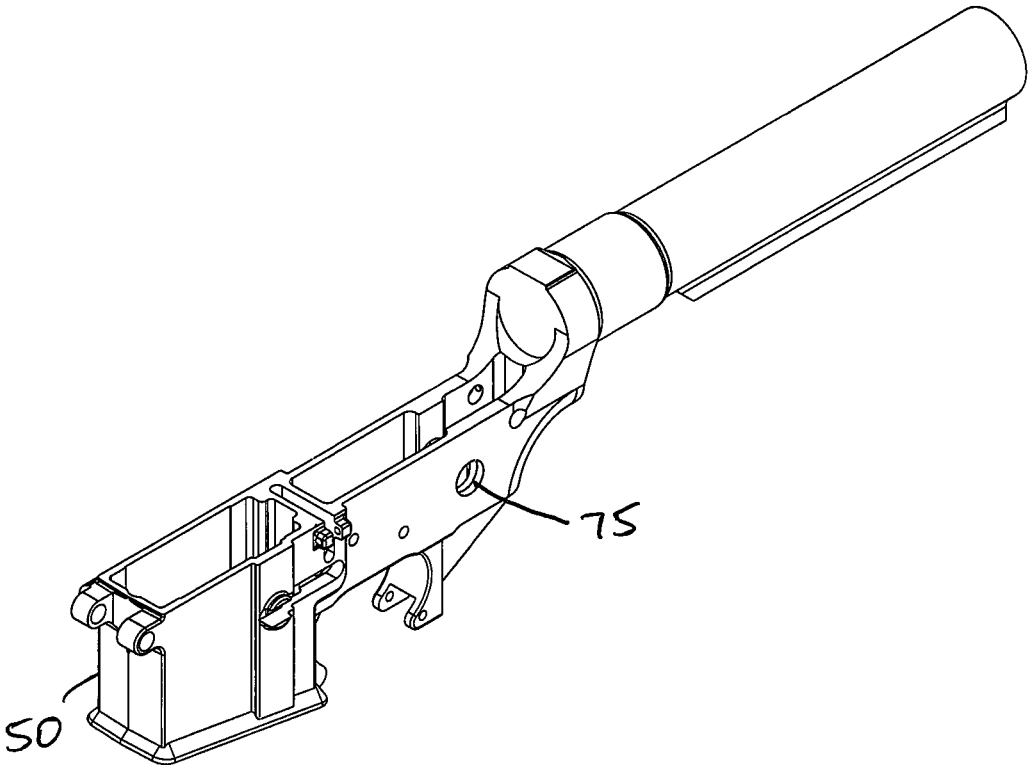
FIG. 3*b* depicts a left side of the disassembled lower receiver shown in FIG. 3*a*.

The firing mechanism 80 is capable of operation at least in a SEMI-AUTOMATIC mode. The firing mechanism 80 may also be placed in a SAFE mode. The lower receiver 50 has a fire control assembly 70 (shown in FIGS. 2*a* and 4*a-b*) allowing a user to select the mode of operation of the firing mechanism 80. The fire control assembly 70 is provided in bore 75 (shown in FIGS. 3*a-b*) of lower receiver 50 with a detent (not shown) and detent spring (not shown).

Figure 4A:
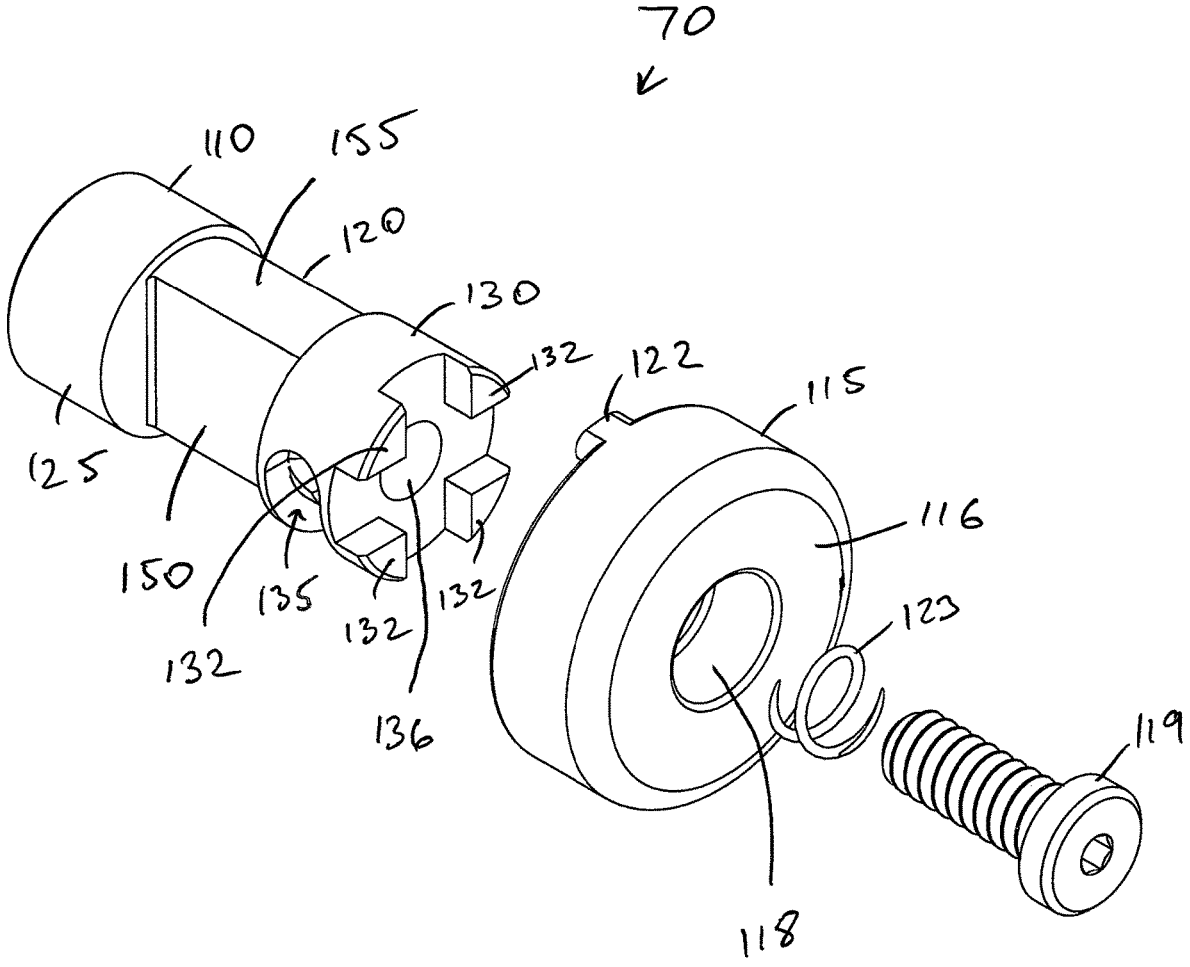
FIG. 4*a* depicts an exploded view of a fire control assembly according to some embodiments presently disclosed.
Figure 4B:
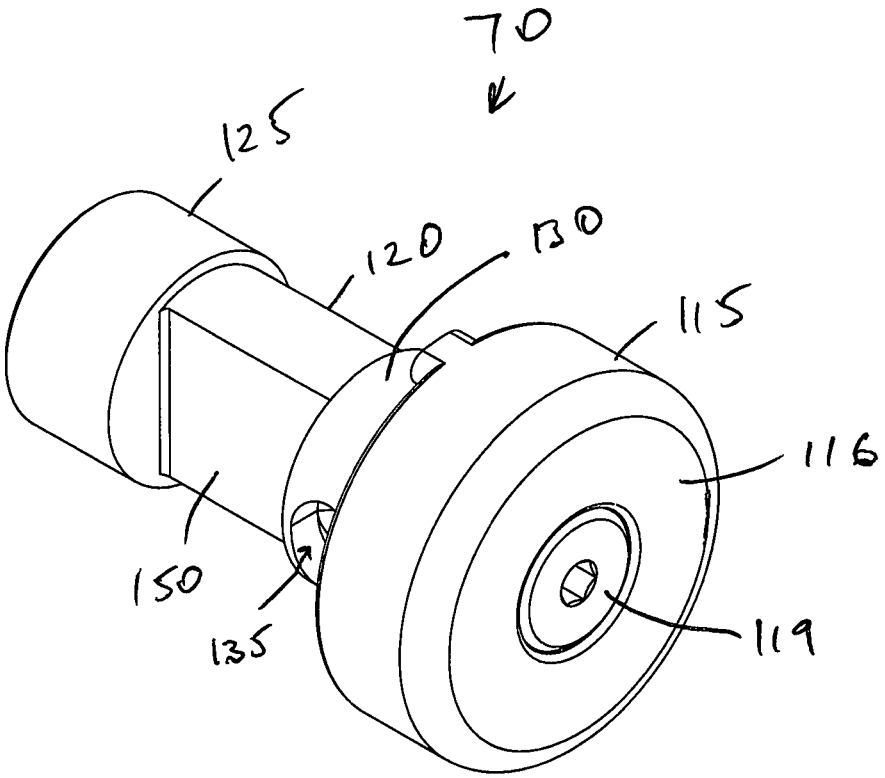
FIG. 4*b* depicts an assembled view of the fire control assembly shown in FIG. 4*a*.

Referring now to FIG. 4*a*, there is shown an exploded view of the fire control assembly 70 according to some embodiments presently disclosed. Referring now to FIG. 4*b*, there is shown an assembled view of the fire control assembly 70 shown in FIG. 4*a*. According to some embodiments presently disclosed, the fire control assembly 70 has a pivotable shaft 110 and a selector member 115.

According to some embodiments presently disclosed, the shaft 110 comprises a camming portion or surface 120 and a support portion(s) 125, 130. Support portion(s) 125, 130 act as supporting surfaces and support the fire control assembly 70 in the bore 75 (shown in FIGS. 2*a-b*) of lower receiver 50. The support portions 125, 130 may have a common diameter. The support portions 125, 130 may have different diameters.

Figure 6:
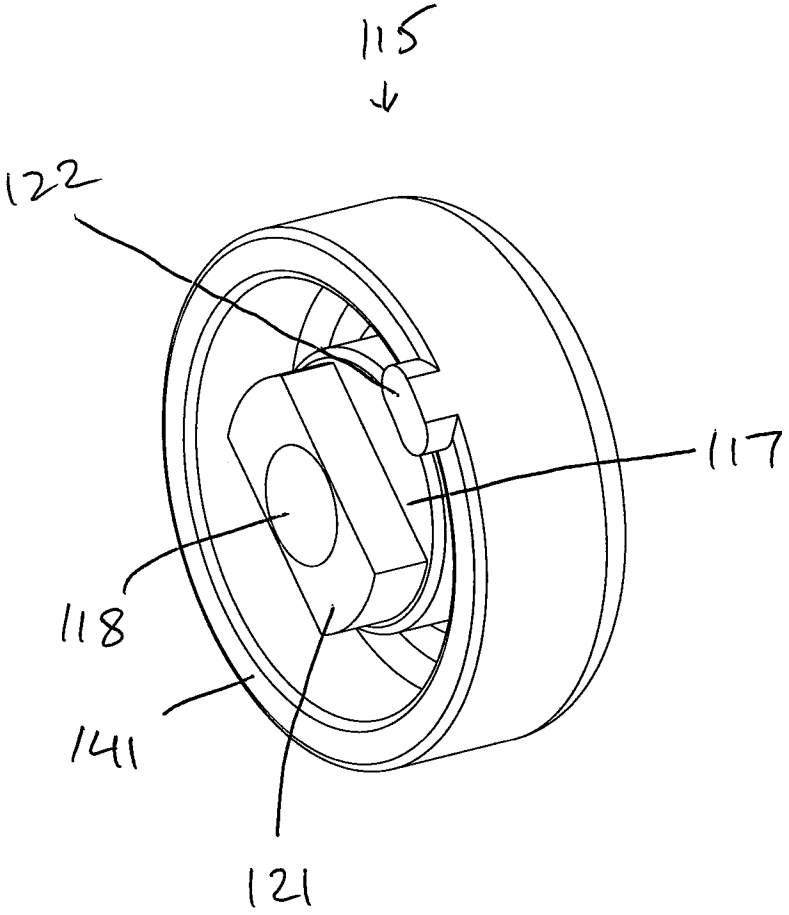
FIG. 6 depicts a perspective view of a selector member according to some embodiments presently disclosed.

According to some embodiments presently disclosed, the selector member 115 comprises a front surface 116 (shown in FIGS. 4*a-b*) positioned away from the lower receiver 50 and a rear surface 117 (shown in FIG. 6) positioned adjacent with the lower receiver 50. According to some embodiments presently disclosed, the selector member 115 comprises a rear edge 141 (shown in FIG. 6) configured to abut a portion of the lower receiver 50. The selector member 115 further comprises a fastener through aperture 118 configured to accommodate a fastener 119. The fastener 119 may be a pin, a screw, a set screw, a full dog point set screw, or a dogleg set screw. The selector member 115 further comprises a first tab (i.e. first protrusion) 121 (shown in FIG. 6) extending towards the lower receiver 50. According to some embodiments presently disclosed, the first tab 121 extends from the rear surface 117. The selector member 115 further comprises a second protrusion 122 (shown in FIG. 6) extending towards the lower receiver 50. According to some embodiments presently disclosed, the second protrusion 122 extends from the rear edge 141. According to some embodiments presently disclosed, the selector member 115 is circular in shape.

According to some embodiments presently disclosed, the support portion 130 comprises a plurality of protrusions 132 (shown in FIGS. 4*a* and 7) with a fastener aperture 136 bored into the shaft 110. The fastener aperture 136 is configured to accommodate the fastener 119. The protrusions 132 are separated so as to accommodate the first tab 121 of the selector member 115. According to some embodiments presently disclosed, the selector member 115 is coupled with the support portion 130 using the fastener 119 so as to position the first tab 121 between the protrusions 132. According to some embodiments presently disclosed, a spring member 123 may be positioned between the fastener 119 and the selector member 115. The spring member 123 urges the selector member 115 toward the shaft 110. According to some embodiments presently disclosed, the spring member 123 further allows the user to pull the selector member 115 against the force of the spring member 123 and away from the shaft 110 so as to reposition (i.e. reorient) the first tab 121 between the protrusions 132. According to some embodiments presently disclosed, the spring member 123 further allows the user to pull the selector member 115 against the force of the spring member 123 and away from the shaft 110 so as to reposition (i.e. reorient) the first tab 121 with respect to the protrusions 132.

Figure 7:
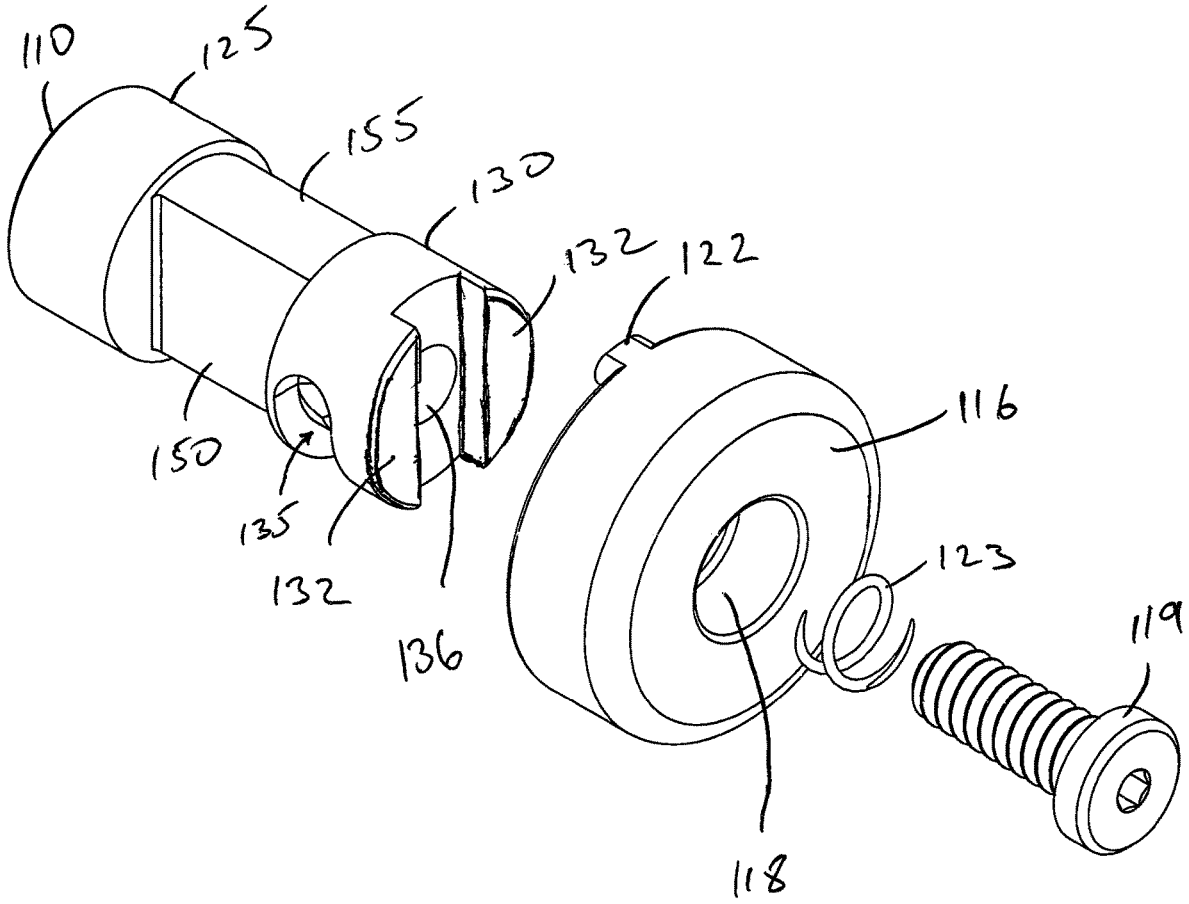
FIG. 7 depicts an exploded view of another fire control assembly according to some embodiments presently disclosed.

According to some embodiments presently disclosed, the support portion 130 comprises four protrusions 132 as shown in FIG. 4*a*. According to some embodiments presently disclosed, the support portion 130 comprises three protrusions 132 (not shown). According to some embodiments presently disclosed, the support portion 130 comprises two protrusions 132 as shown in FIG. 7. According to some embodiments presently disclosed, the support portion 130 is bifurcated 132 with a fastener hole 136 bored into the shaft 110. The bifurcated portion 132 is configured to accommodate the first tab 121 of the selector member 115.

Figure 9A:
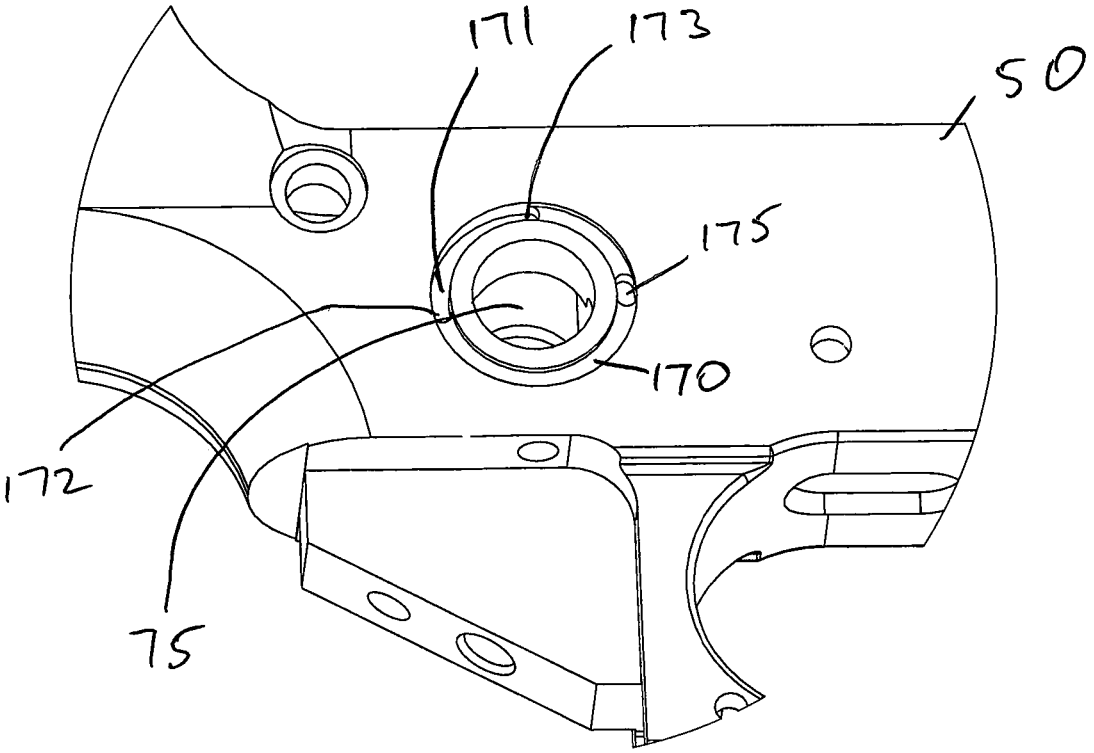
FIG. 9*a* depicts a closeup, angled view of a bore on the right side of the lower receiver according to some embodiments presently disclosed.
Figure 9B:
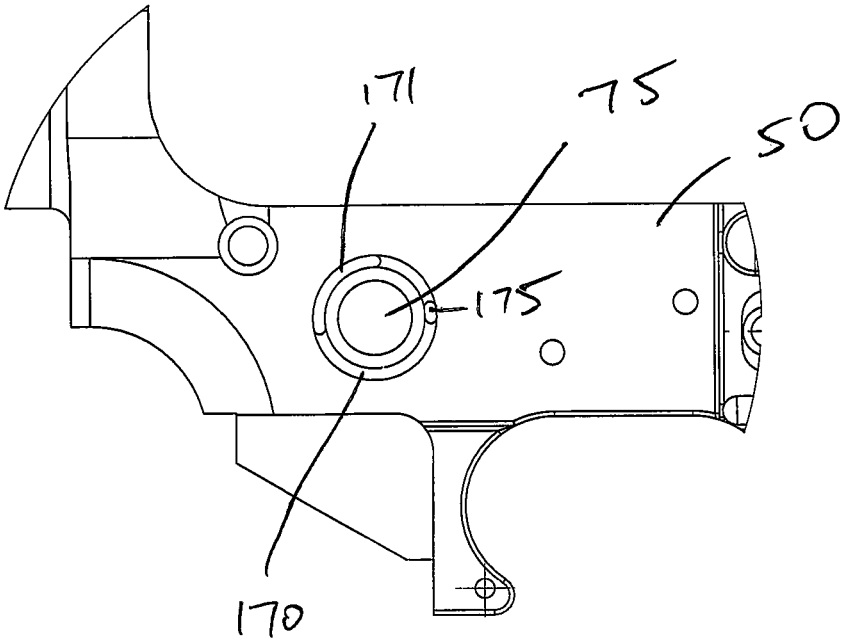
FIG. 9*b* depicts a closeup, side view of the bore on the right side of the lower receiver shown in FIG. 9*a*.

According to some embodiments presently disclosed, the lower receiver 50 comprises a first channel 170 around the bore 75 (shown in FIGS. 9*a-b*). According to some embodiments presently disclosed, the first channel 170 is configured to accommodate at least a portion of the selector member 115. According to some embodiments presently disclosed, the first channel 170 is configured to accommodate at least a portion of the rear edge 141 of the selector member 115. According to some embodiments presently disclosed, the first channel 170 is circular. According to some embodiments presently disclosed, the first channel 170 matches the shape of the selector member 115.

According to some embodiments presently disclosed, the lower receiver 50 comprises a second channel 171 (shown in FIGS. 9*a-b*). The second channel 171 may be positioned in the first channel 170 (shown in FIGS. 9*a-b*). The second channel 171 is configured to accommodate the second protrusion 122. The second protrusion 122 is free to move from first end 172 of the second channel 171 to the second end 173 of the second channel 171. According to some embodiments presently disclosed, when the second protrusion 122 is at the first end 172, the camming surface 120 is in a "SEMI-AUTOMATIC" position (shown in FIG. 8*a*). According to some embodiments presently disclosed, when the second protrusion 122 is at the second end 173, the camming surface 120 is in a "SAFE" position (shown in FIG. 8*b*).

According to some embodiments presently disclosed, the lower receiver 50 comprises a cavity 175 (shown in FIGS. 9*a-b*). The cavity 175 may be positioned in the first channel 170 (shown in FIGS. 9*a-b*). The cavity 175 is configured to accommodate the second protrusion 122. According to some embodiments presently disclosed, when the camming surface 120 is in a "SAFE" position (shown in FIG. 8*b*), the user can move the second protrusion 122 from the second channel 171 by pulling the selector member 115 against the force of the spring member 123 and away from the shaft 110 and rotating the second protrusion 122 towards the cavity 175. When the second protrusion 122 lines up with the cavity 175, releasing the selector member 115 will allow the force of the spring member 123 to lock the second protrusion 122 in the cavity 175. According to some embodiments presently disclosed, when the second protrusion 122 is at the cavity 175, the selector member 115 is in the "LOCKED" position while the camming surface 120 remains in a "SAFE" position (shown in FIG. 8*c*).

According to some embodiments presently disclosed, the camming surface 120 cannot be positioned in the "SEMI-AUTOMATIC" position without releasing the second protrusion 122 from the cavity 175. To release the second protrusion 122 from the cavity 175, the user needs to position the second protrusion 122 in the second channel 171 by pulling the selector member 115 against the force of the spring member 123 and away from the shaft 110 and rotating the second protrusion 122 towards the second channel 171. When the second protrusion 122 lines up with the second channel 171, releasing the selector member 115 will allow the force of the spring member 123 to position the second protrusion 122 in the second channel 171. The act of pulling and rotating the selector member 115 from the "LOCKED" position is configured to be a difficult task for children to accomplish thereby preventing them from firing the firearm.

According to some embodiments presently disclosed, the camming portion 120 of the fire control assembly 70 is a trigger camming surface 120. The shaft 110 having camming portion 120 may be cast of metal with the sections cast therein, however in alternate embodiments such sections or the part itself could be cut or machined in one part out of a billet of material if desired.

Figure 5A:
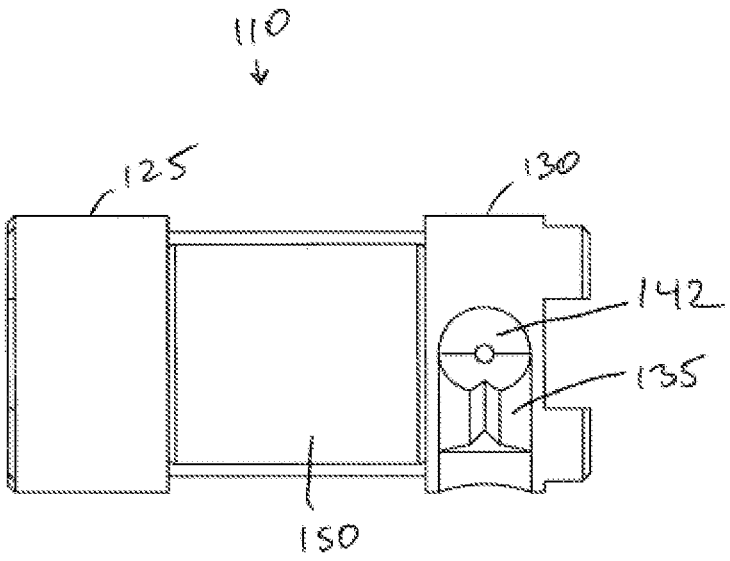
FIG. 5*a* depicts a front view of a shaft according to some embodiments presently disclosed.
Figure 5B:
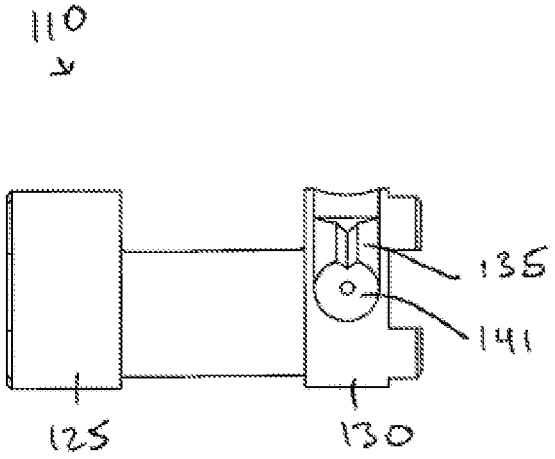
FIG. 5*b* depicts a side view of the shaft shown in FIG. 5*a*.
Figure 5C:
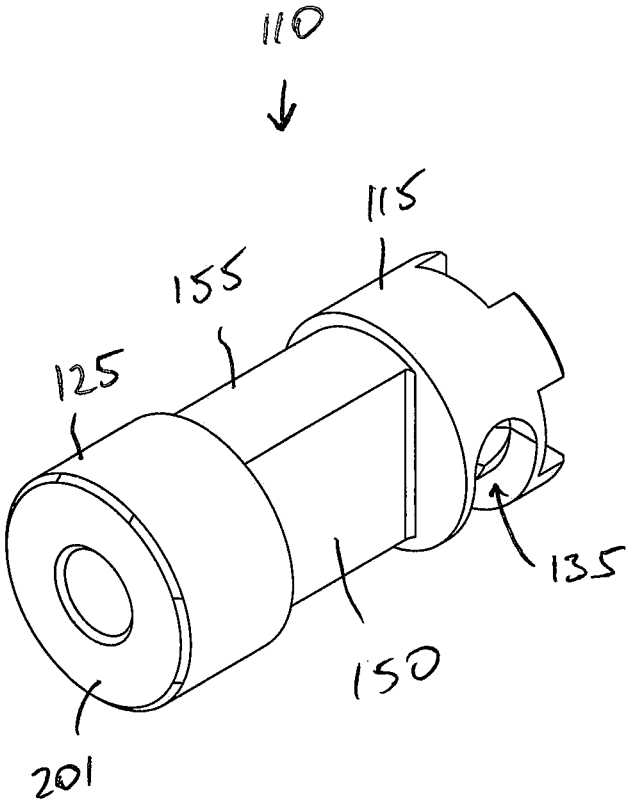
FIG. 5*c* depicts a perspective view of the shaft shown in FIG. 5*a*.

According to some embodiments presently disclosed, the shaft 110 comprises a selector positioning or indexing feature 135 (shown in FIGS. 4*a* and 5*a-b*). The selector position feature 135 may be provided on the support portion 130 adjacent to the selector member 115 (shown in FIG. 4*a*) or it may be provided on the support portion 125 (not shown) at an opposite end of the shaft 110 from the selector member 115. The selector positioning feature 135 engages spring loaded detent (not shown). According to some embodiments presently disclosed, the positioning feature 135 comprise indexing or detent engagement locations (i.e. recesses) 141 and 142 (shown in FIGS. 5*a-b*). The detent engagement locations 141 and 142 provide the fire control assembly 70 with an indexer for holding the shaft 110 in each selector position (e.g. "SAFE", "SEMI-AUTOMATIC"). The detent engagement locations 141 and 142 are adapted to be engaged by the detent or moveable plunger (not shown) for holding the shaft 110 in each selectable position (e.g. "SAFE", "SEMI-AUTOMATIC"). According to some embodiments presently disclosed, the detent engagement recesses 141 and 142 are generally rounded/conical to complement a rounded/conical plunger (not shown). According to some embodiments presently disclosed, the detent engagement recesses 141 and 142 may have any other desired shape.

According to some embodiments presently disclosed, selector positioning feature 135 is located around circumference of the support portion 130 (shown in FIGS. 4*a* and 5*a-b*) to position the shaft 110 in "SAFE" and/or "SEMI-AUTOMATIC" modes. Hence, the circumferential pitch between adjacent detent engagement recesses 141 and 142 is the same as the rotational separation between selector positions. According to some embodiments presently disclosed, selector positioning feature 135 is located around circumference of the support portion 125 (not shown) to position the shaft 110 in "SAFE" and/or "SEMI-AUTOMATIC" modes. Hence, the circumferential pitch between adjacent detent engagement recesses 141 and 142 is the same as the rotational separation between selector positions.

Figure 8A:
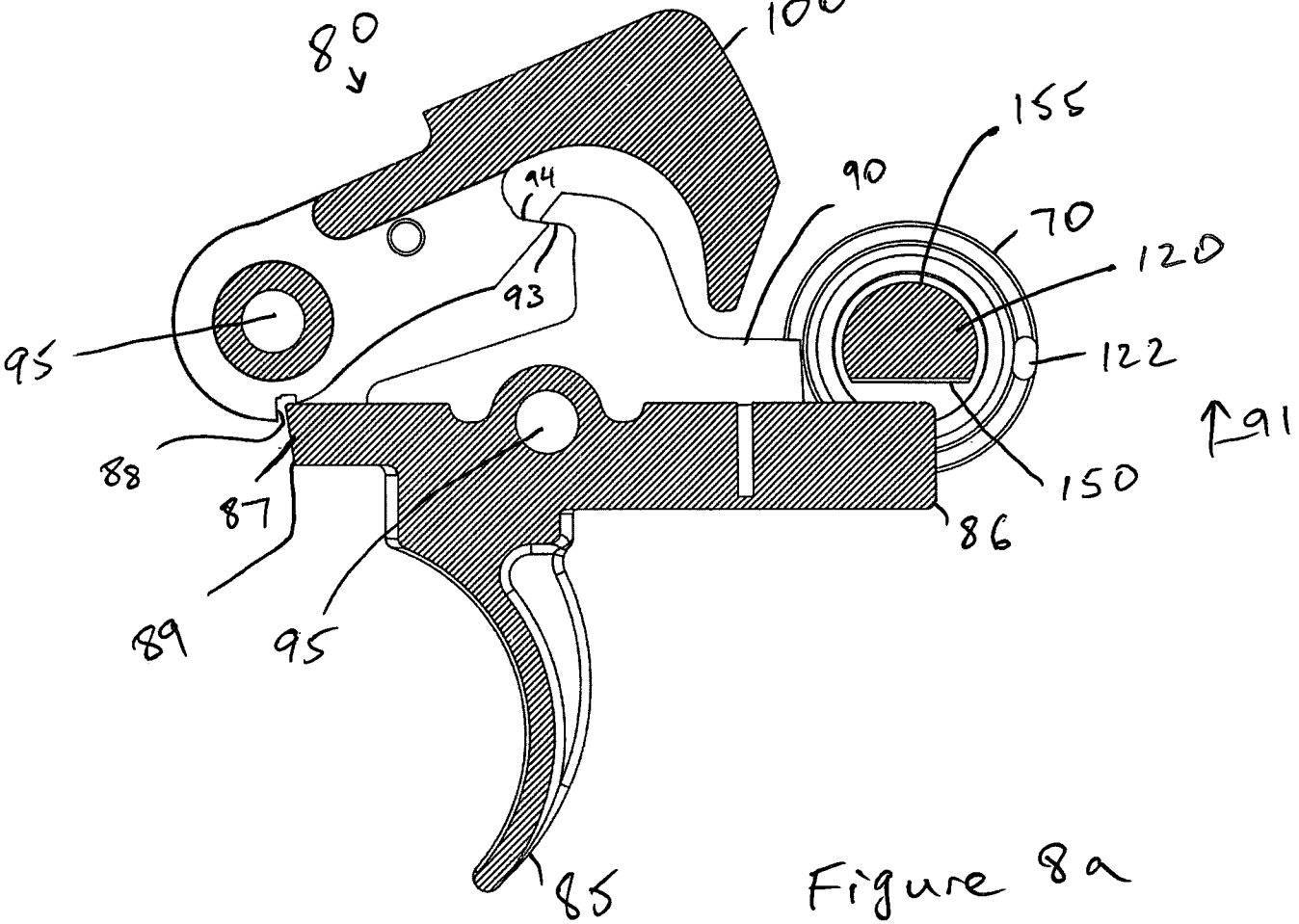
FIG. 8*a* depicts a side view of a camming surface of the fire control assembly in a "SEMI-AUTOMATIC" position.
Figure 8B:
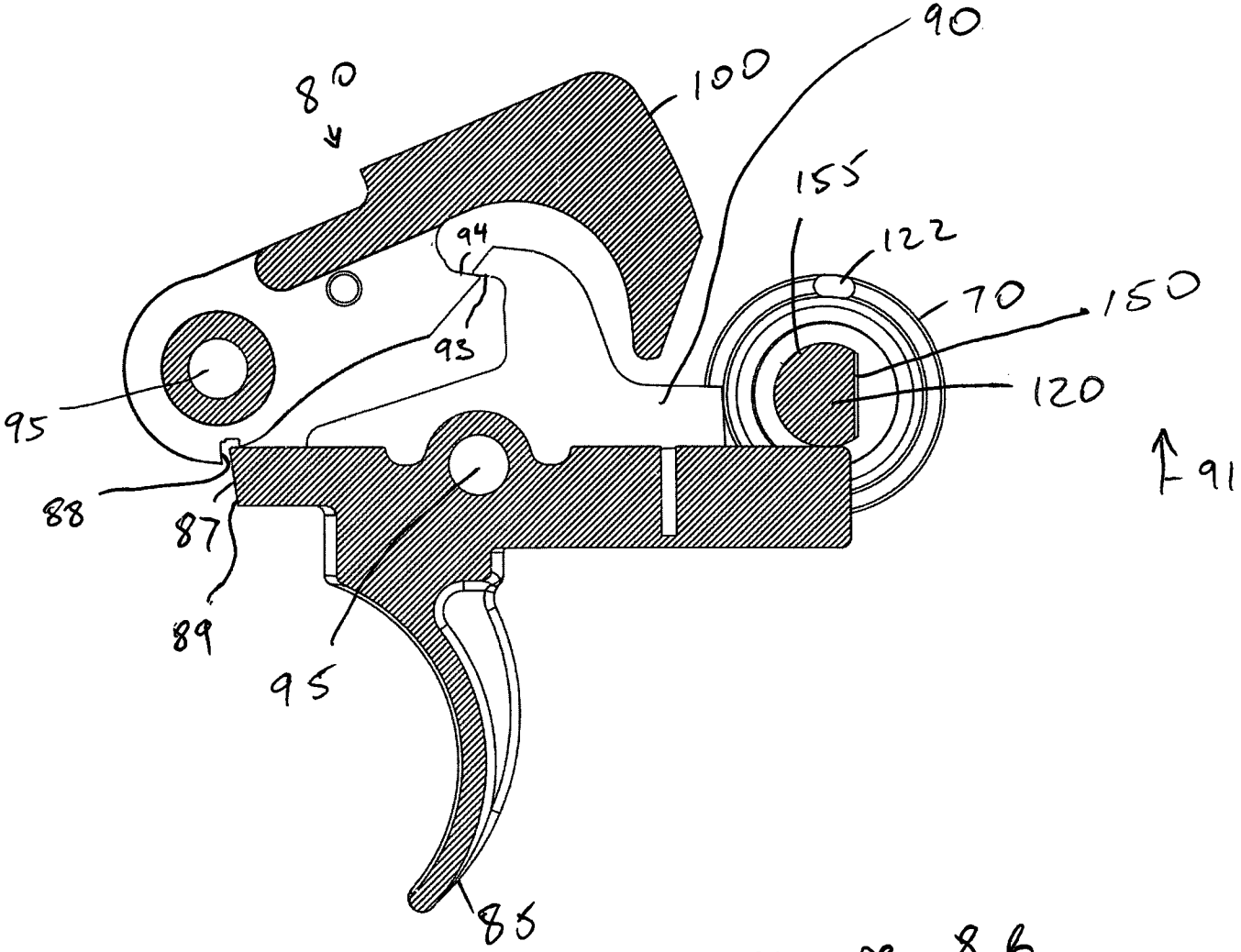
FIG. 8*b* depicts a side view of the camming surface of the fire control assembly in a "SAFE" position.
Figure 8C:
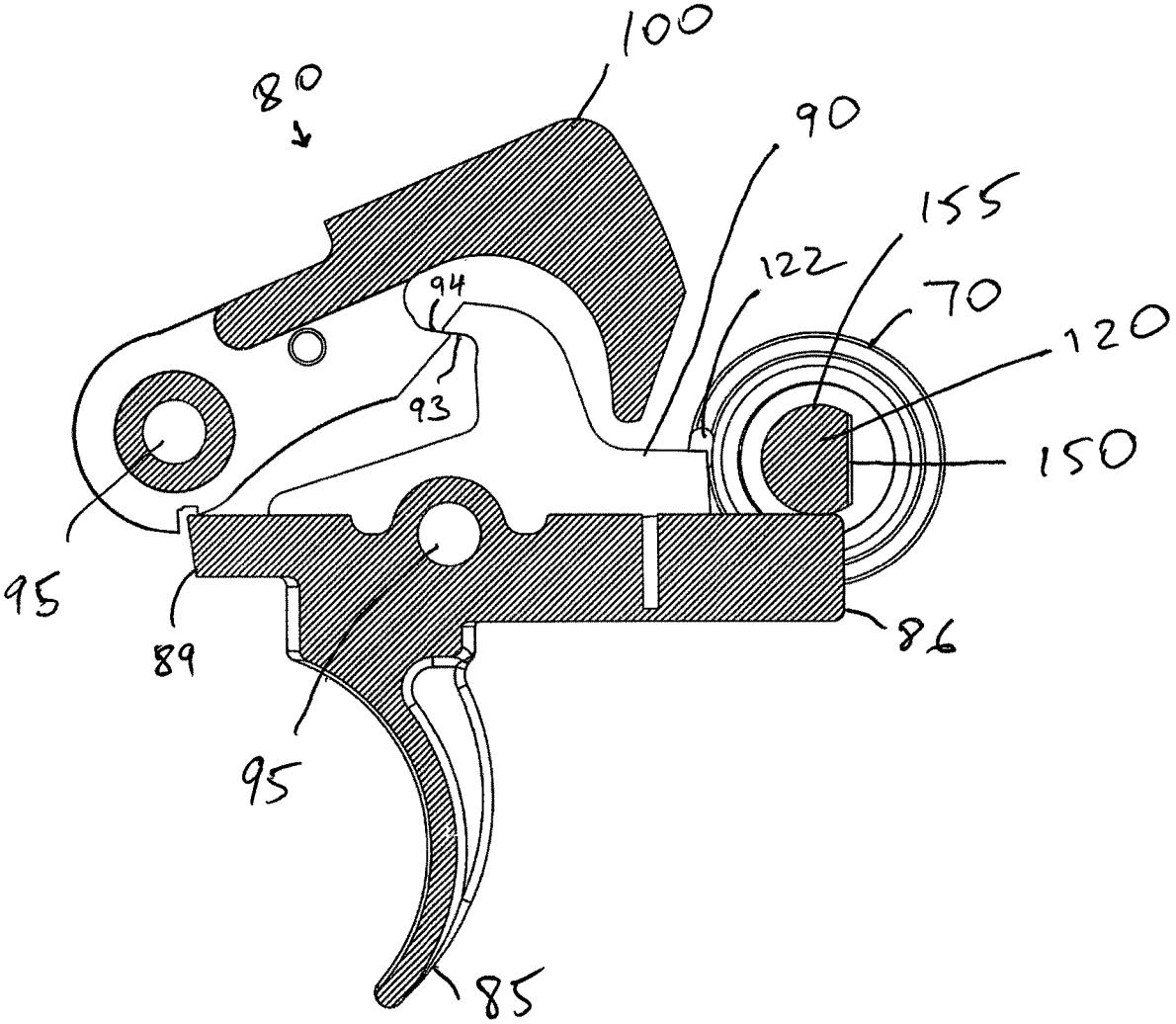
FIG. 8*c* depicts a side view of the selector member in a "LOCKED" position.

Referring to FIGS. 8*a-c*, the firing mechanism 80 may comprise a trigger 85 with trigger spring (not shown), a disconnector 90, disconnector spring (not shown), and a hammer 100 with hammer spring (not shown) disposed in the opening 60 of the lower receiver 50 on pins 95.

According to some embodiments presently disclosed, the hammer 100 (shown in FIGS. 8*a-c*) is pivotally mounted with pin 95 to the lower receiver 50, the trigger 85 is pivotally mounted to the lower receiver 50 with another pin 95. In alternate embodiments the hammer 100 and trigger 85 may be movably mounted to the lower receiver 50 in any other desired manner.

According to some embodiments presently disclosed, the trigger 85, as seen best in FIGS. 8*a-c*, comprises a rear portion 86 and a front edge 89. In alternate embodiments, the trigger 85 may have any other desired shape. According to some embodiments presently disclosed, the front edge 89 of the trigger 85, defines main sear 87, and is adapted to catch a notch 88 of the hammer 100 when the hammer 100 is in a locked position (shown in FIGS. 8*a-c*) and, release the hammer 100 when the trigger 85 is pulled, thereby allowing the hammer 100 to return from the cocked position to the battery position (not shown) under impetus of a hammer spring (not shown).

According to some embodiments presently disclosed, the disconnector 90 is may also be pivotally mounted on the pin 95. The edge 93 of the disconnector 90 is adapted to catch the catch 94 of the hammer 100 (as shown in FIGS. 8*a-c*) after the trigger 85 is pulled and as the hammer is cocked by the cyclic action of the firearm. The disconnector 90 is moved, when the trigger 85 is released thereby releasing the hammer 100. A spring (not shown) may be provided, such as between the trigger 85 and disconnector 90 for example, to bias the disconnector 90 towards the control hammer 100. Release of the hammer 100 by the disconnector 90 allow the sear 87 to engage notch 88 of the hammer 100, holding the hammer 100 in its cocked position.

The trigger camming surface 120 may be arranged so that when the fire control assembly 70 is installed in a lower receiver 50, the trigger camming surface 120, upon selection of a desired mode of operation with the selector member 115, is positioned relative to trigger 85 to place the firearm in an operation mode corresponding to the selection. The trigger camming surface 120 is formed to be positioned for engagement and disengagement of the trigger 85, thereby giving effect to the selector positions that may be about 90° apart. It is to be understood that other selector position angles may be provided.

Figure 10A:
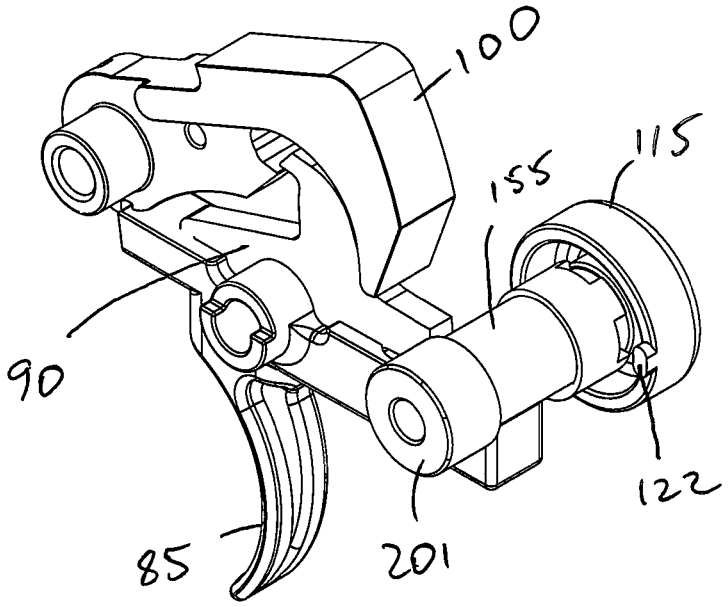
FIG. 10*a* depicts a perspective view of the selector member of the fire control assembly in a "SEMI-AUTOMATIC" position.
Figure 10B:
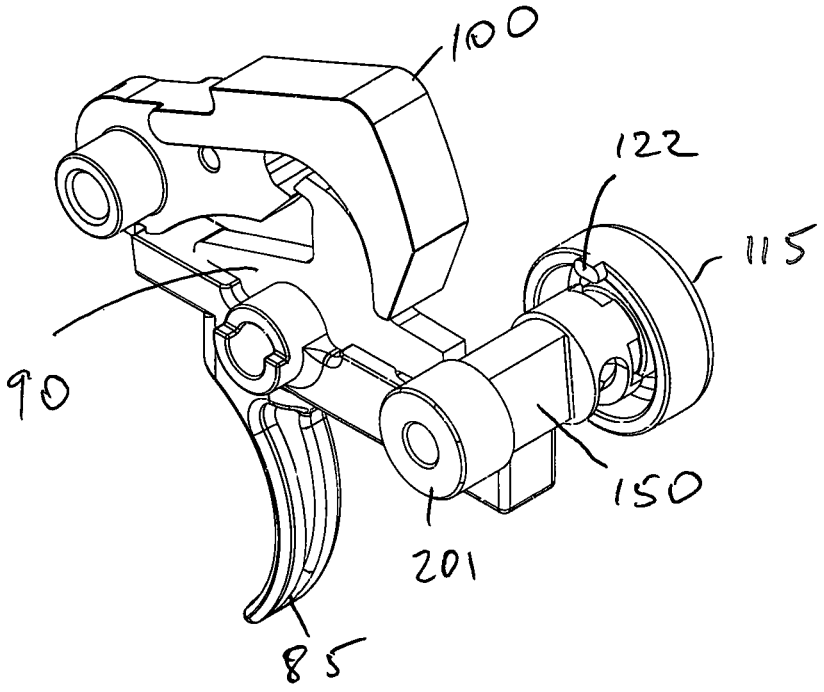
FIG. 10*b* depicts a perspective view of the selector member of the fire control assembly in a "SAFE" position.

According to some embodiments presently disclosed, the camming surface 120 has a first surface 150 (shown in FIG. 4*a*) and a second surface 155 (shown in FIG. 4*a*) rotatably positioned adjacent to the trailing leg 86 of the trigger 85 when the shaft 110 is in a "SEMI-AUTOMATIC" position (shown in FIGS. 8*a* and 10*a*) and "SAFE" position (shown in FIGS. 8*b* and 10*b*). According to some embodiments presently disclosed, the first surface 150 may be a flat surface spaced away from the trailing leg 86 of the trigger 85 to allow the trailing leg 86 of the trigger 85 to move in the first direction 91 (shown in FIG. 8*a*). According to some embodiments presently disclosed, the second surface 155 may be a semicircular surface positioned adjacent with the trailing leg 86 of the trigger 85 to prevent and/or limit the movement of the trailing leg 86 in the first direction 91 (shown in FIG. 8*b*). Thus the second surface 155 may limit axial rotation of the trigger 85 at the rear portion 86 on pin 95 in direction 91.

According to some embodiments presently disclosed, the second surface 155 may be a semicircular surface abutting the trailing leg 86 of the trigger 85 to prevent the movement of the trailing leg 86 move in the first direction 91 (shown in FIG. 8*b*).

Referring again to FIG. 8*a*, there is shown a partial side elevation view of a firing mechanism 80 with the camming surface 120 in the "SEMI-AUTOMATIC" position. Referring also to FIG. 8*b*, there is shown a partial side elevation view of a firing mechanism 80 with the camming surface 120 in the "SAFE" position. Referring also to FIG. 8*c*, there is shown a partial side elevation view of a firing mechanism 80 with the camming surface 120 in the "SAFE" position and the selector member 115 in the "LOCKED" position.

When the camming surface 120 is rotated to the "SEMI-AUTOMATIC" position, the camming surface 120 is rotated to the position shown in FIG. 8*a*. In this position, there is a space between the surface 150 and the end portion 86 of the trigger 85. This allows the trigger to be pulled to release hammer 100 and leaves disconnect 90 free to engage hammer 100 after the trigger 85 has been pulled. With the fire control selector in the "SAFE" position shown in FIG. 8*b*, the end portion 86 of trigger 85 may contact the surface 155 of camming surface 120. This limits the rotation of the trigger 85, which locks the main sear 87 on the trigger 85 in position engaging catch 88 of the hammer 100. In this position, the trigger 85 can not be pulled sufficiently to release hammer 100.

Figure 10C:
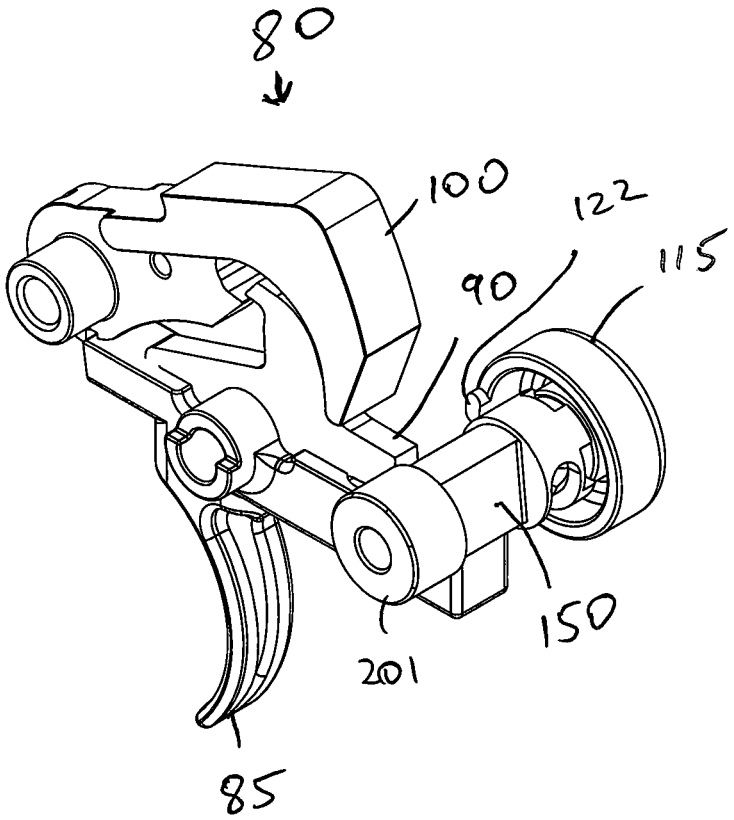
FIG. 10*c* depicts a perspective view of the selector member of the fire control assembly in a "LOCKED" position.

The camming surface 120 can be rotated clockwise and counterclockwise to move from firing selections including "SAFE" and "SEMI-AUTOMATIC" and back to "SAFE". With the camming surface 120 in the "SAFE" position, the user can prevent the camming surface 120 from being rotated to "SEMI-AUTOMATIC" position by pulling the selector member 115 against the force of the spring member 123 and away from the shaft 110 and rotating the second protrusion 122 towards the cavity 175. When the second protrusion 122 lines up with the cavity 175, releasing the selector member 115 will allow the force of the spring member 123 to lock the second protrusion 122 in the cavity 175. When the second protrusion 122 is at the cavity 175, the selector member 115 is in the "LOCKED" position while the camming surface 120 is prevented from rotating to the "SEMI-AUTOMATIC" position (shown in FIGS. 8*c* and 10*c*).

According to some embodiments presently disclosed, the support portion 125 comprises an outer surface 201 (shown in FIGS. 2*b*, 5*c* and 10*a-c*). According to some embodiments presently disclosed, the outer surface 201 may at least partially protrude from the bore 75 of the lower receiver 50 when the fire control assembly 70 is positioned within the bore 75. According to some embodiments presently disclosed, the outer surface 201 may be substantially flush with an outer surface of the lower receiver 50 when the fire control assembly 70 is positioned within the bore 75.

Figure 11:
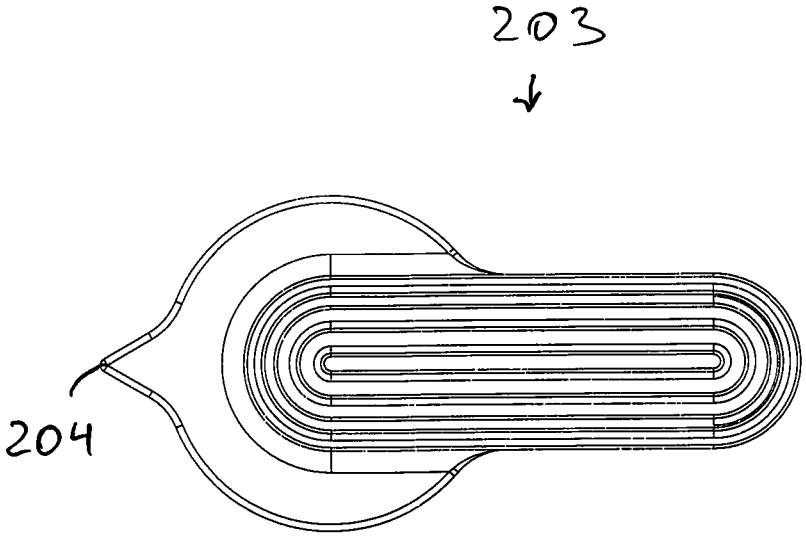
FIG. 11 depicts a side view of an outer handle according to some embodiments presently disclosed.
Figure 12:
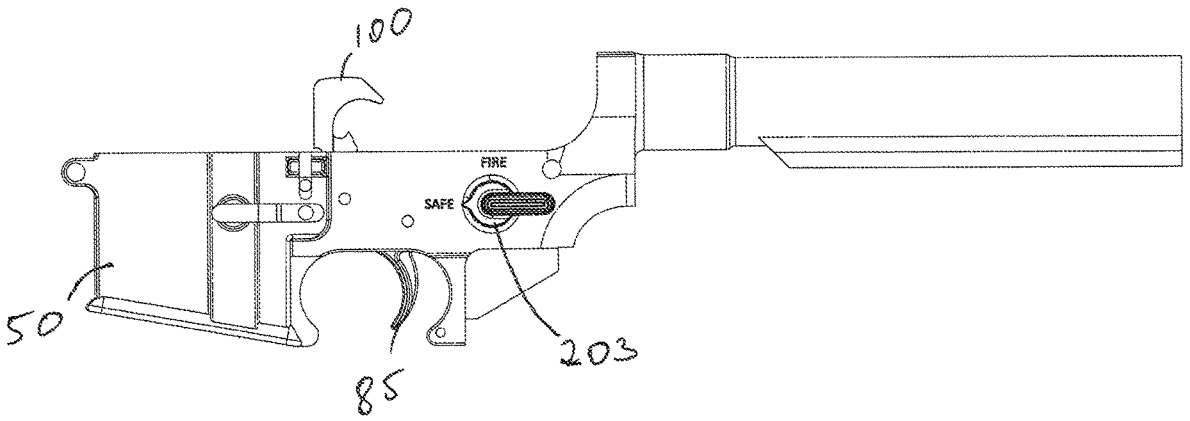
FIG. 12 depicts a right side view of the lower receiver according to some embodiments presently disclosed.

According to some embodiments presently disclosed, the support portion 125 comprises an outer handle 203 (shown in FIGS. 11-12). According to some embodiments presently disclosed, the outer handle 203 protrudes from the bore 75 of the lower receiver 50 when the fire control assembly 70 is positioned within the bore 75 (shown in FIG. 12).

According to some embodiments presently disclosed, the outer handle 203 is shaped and positioned on the side of the lower receiver 50 to allow user operation (e.g. toggle) of the outer handle 203 with fingers (e.g. the thumb) on the same hand as that with which the user is pulling the trigger 85 (i.e. the trigger hand). According to some embodiments presently disclosed, the outer handle 203 has an elongated tab shape and extends rearwards from the selector pivot axis and is rotated to effect selection of the fire control positions of the fire control assembly 70. In this embodiment, the fire control assembly 70 is capable of ambidextrous operation, and may be rotated using either the outer handle 203 or the selector member 115. The outer handle 203 of the fire control assembly 70 may have for example a pointer 204 or other suitable indicator that points to or otherwise indicates a indicated position that corresponds with the selected position of the fire control assembly 70.

Figure 13:
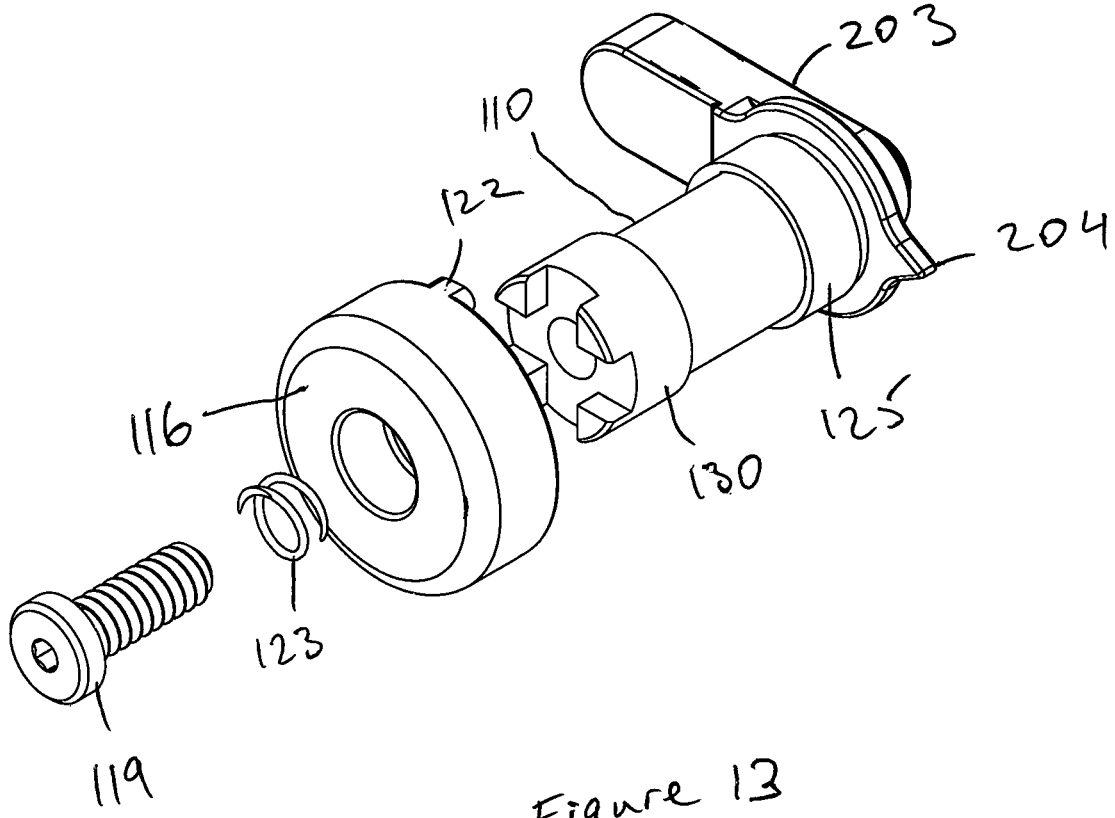
FIG. 13 depicts an exploded view of another fire control assembly according to some embodiments presently disclosed.

Referring to FIG. 13, according to some embodiments presently disclosed, the outer handle 203 is coupled with the support portion 125 using, for example, a fastener (not shown). According to some embodiments presently disclosed, the outer handle 203 extends from the support portion 125. According to some embodiments presently disclosed, the outer handle 203 is integral with the support portion 125.

Figure 14A:
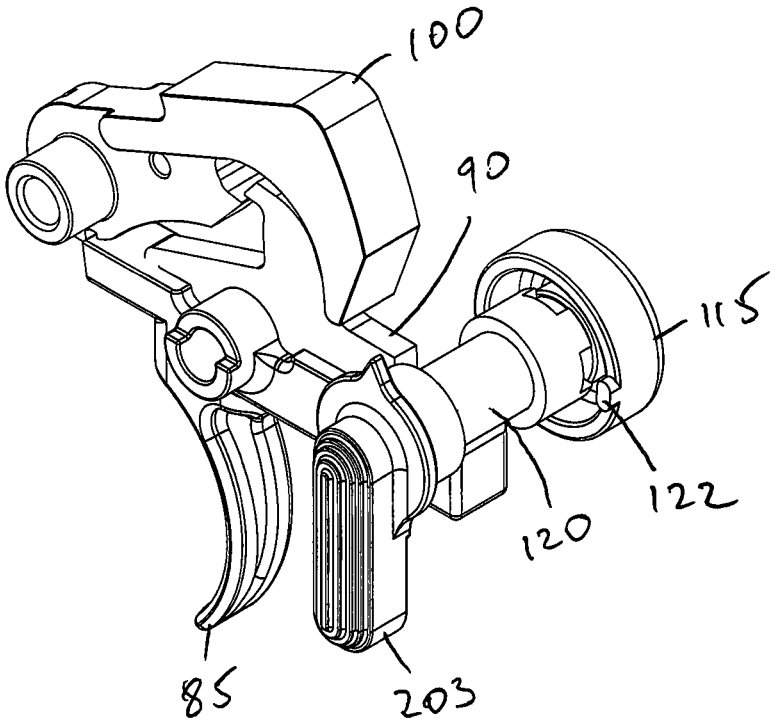
FIG. 14*a* depicts a perspective view of the selector member of the fire control assembly in a "SEMI-AUTOMATIC" position.
Figure 14B:
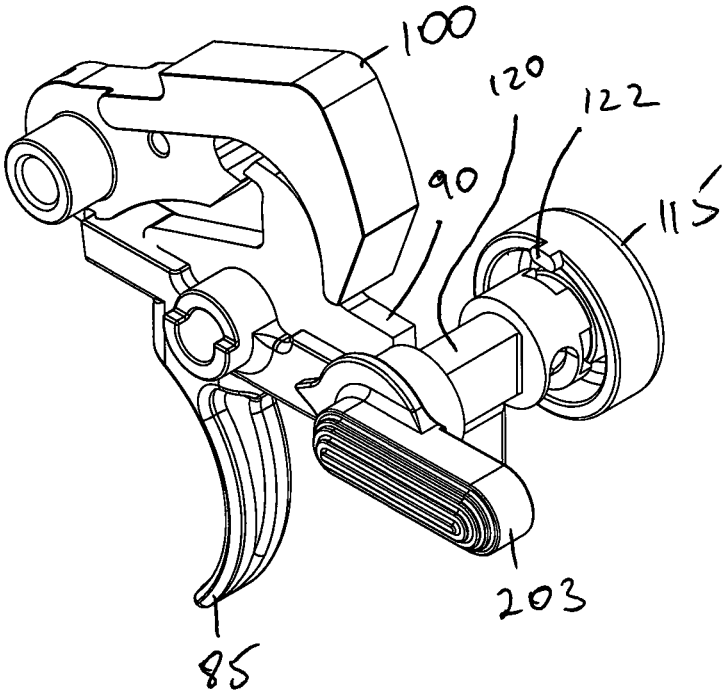
FIG. 14*b* depicts a perspective view of the selector member of the fire control assembly in a "SAFE" position.
Figure 14C:
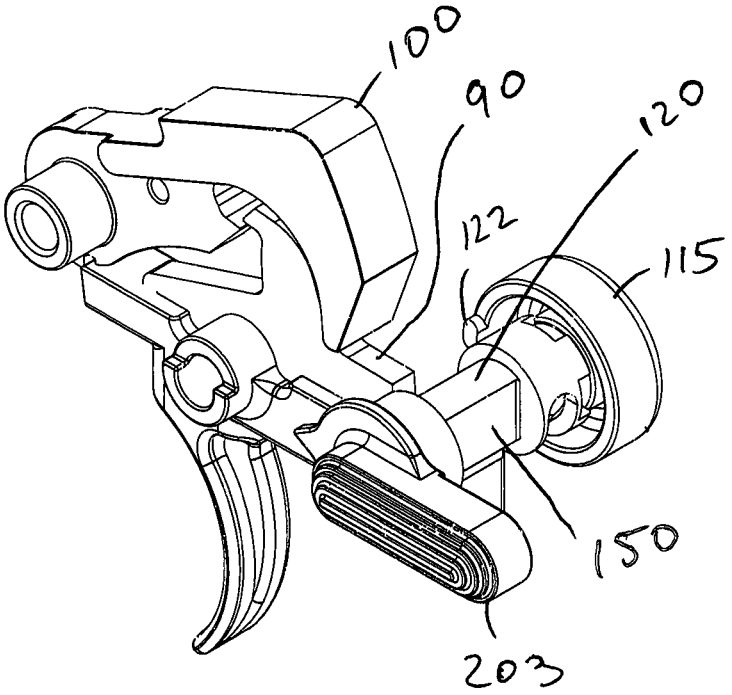
FIG. 14*c* depicts a perspective view of the selector member of the fire control assembly in a "LOCKED" position.

Referring to FIG. 14*a*, there is shown a partial side elevation view of the firing mechanism 80 with the outer handle 203 in the "SEMI-AUTOMATIC" position. Referring also to FIG. 14*b*, there is shown a partial side elevation view of the firing mechanism 80 with the outer handle 203 in the "SAFE" position. Referring also to FIG. 14*b*, while the outer handle 203 is in the "SAFE" position, the selector member 115 is also in the "SAFE" position. Referring also to FIG. 14*c*, there is shown a partial side elevation view of the firing mechanism 80 with the outer handle 203 in the "SAFE" position while the selector member 115 is in the "LOCKED" position. With the outer handle 203 in the "SAFE" position, the user can prevent the camming surface 120 from being rotated to "SEMI-AUTOMATIC" position by pulling the selector member 115 against the force of the spring member 123 and away from the shaft 110 and rotating the second protrusion 122 towards the cavity 175. When the second protrusion 122 lines up with the cavity 175, releasing the selector member 115 will allow the force of the spring member 123 to lock the second protrusion 122 in the cavity 175. When the second protrusion 122 is at the cavity 175, the selector member 115 is in the "LOCKED" position while the outer handle 203 is prevented from rotating to the "SEMI-AUTOMATIC" position (shown in FIG. 14*a*).

According to some embodiments presently disclosed, the fire control assembly 70 comprises another (i.e. second) selector member 215 (shown in FIGS. 15-18). The second selector member 215 comprises a front surface 216 positioned away from the lower receiver 50 and a rear surface 217 positioned adjacent with the lower receiver 50. According to some embodiments presently disclosed, the selector member 215 comprises a rear edge 241 configured to abut the lower receiver 50. The selector member 215 further comprises a fastener through hole 218 configured to accommodate a fastener 219. The fastener 219 may be a pin, a screw, a set screw, a full dog point set screw, or a dogleg set screw. The selector member 215 further comprises a first tab (i.e. first protrusion) 221 extending towards the lower receiver 50. According to some embodiments presently disclosed, the first tab 221 extends from the rear surface 217. The selector member 215 further comprises a second protrusion 222 extending towards the lower receiver 50. According to some embodiments presently disclosed, the second protrusion 222 extends from the rear edge 241. According to some embodiments presently disclosed, the selector member 215 is circular in shape.

According to some embodiments presently disclosed, the support portion 125 comprises a plurality of protrusions 232 (shown in FIG. 15) with a fastener aperture 236 bored into the shaft 110. The fastener aperture 236 is configured to accommodate a fastener 219. The protrusions 232 are separated so as to accommodate the first tab 221 of the selector member 215. According to some embodiments presently disclosed, the selector member 215 is coupled with the support portion 125 using the fastener 219 so as to position the first tab 221 between the protrusions 232. According to some embodiments presently disclosed, a spring member 223 may be positioned between the fastener 219 and the selector member 215. The spring member 223 urges the selector member 215 toward the shaft 110. According to some embodiments presently disclosed, the spring member 223 further allows the user to pull the selector member 215 against the force of the spring member 223 and away from the shaft 210 so as to reposition (i.e. reorient) the first tab 221 between the protrusions 232. According to some embodiments presently disclosed, the spring member 223 further allows the user to pull the selector member 215 against the force of the spring member 223 and away from the shaft 110 so as to reposition (i.e. reorient) the first tab 221 with respect to the protrusions 232.

Figure 15:
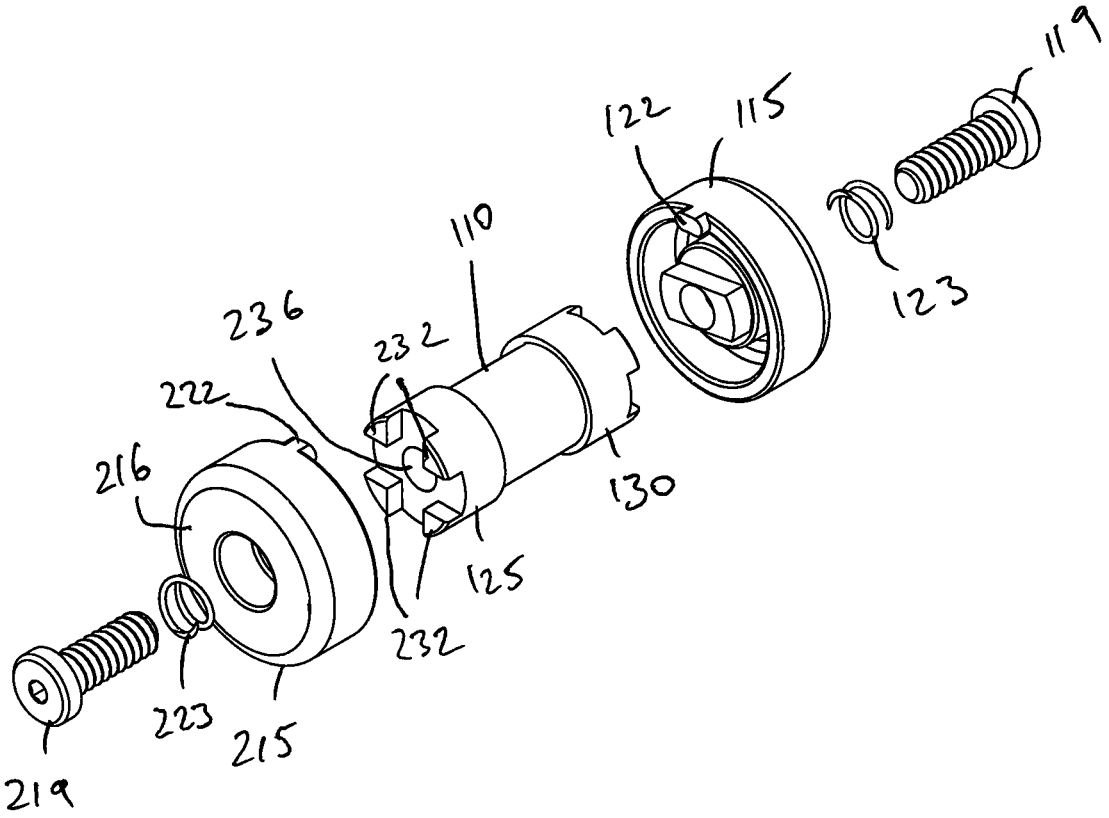
FIG. 15 depicts an exploded view of another fire control assembly according to some embodiments presently disclosed.
Figure 16:
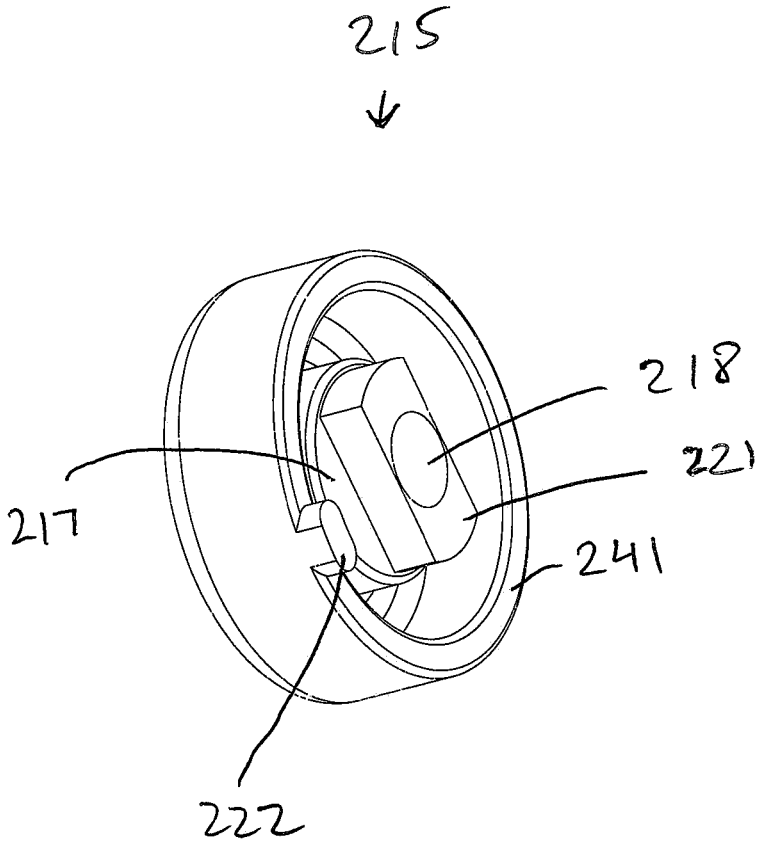
FIG. 16 depicts a perspective view of another selector member according to some embodiments presently disclosed.
Figure 17:
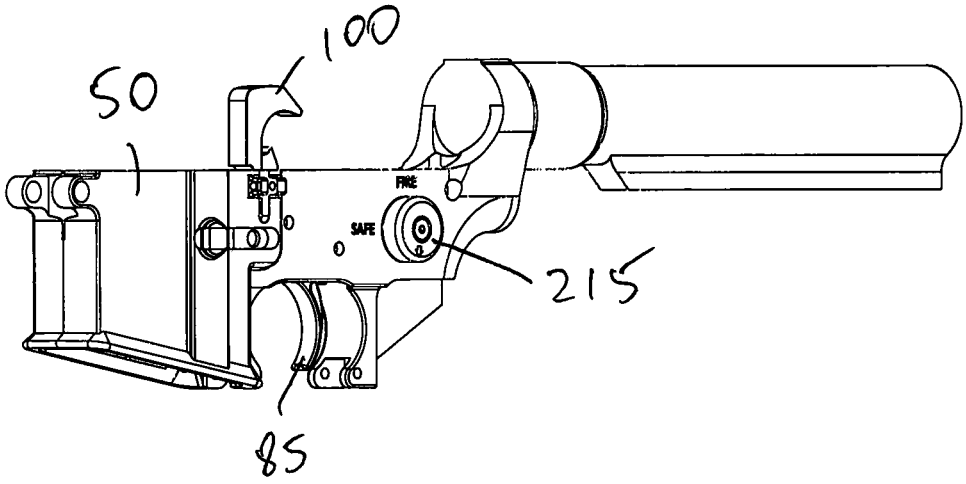
FIG. 17 depicts a perspective view of a lower receiver with a selector member on the left side of the lower receiver according to some embodiments presently disclosed.
Figure 18:
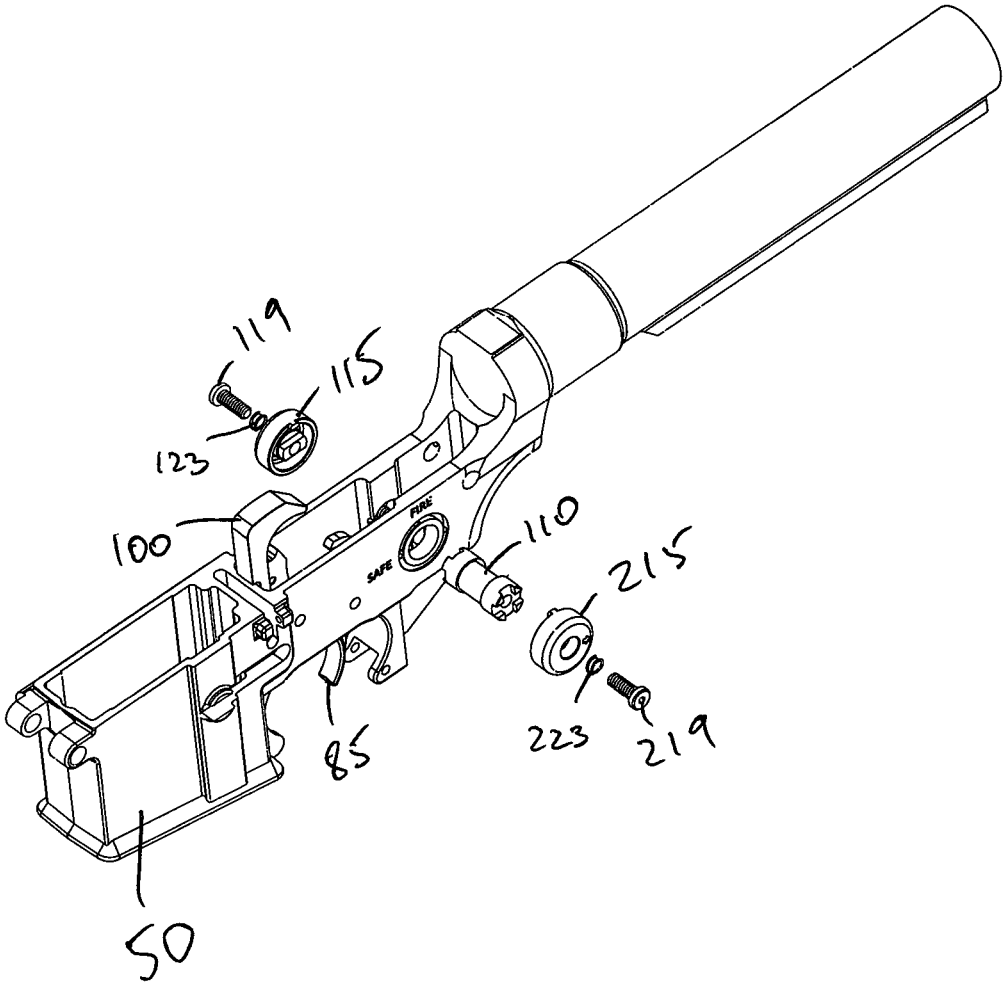
FIG. 18 depicts an exploded view of the lower receiver shown in FIG. 17.

According to some embodiments presently disclosed, the support portion 125 comprises four protrusions 232 as shown in FIG. 15. According to some embodiments presently disclosed, the support portion 125 comprises three protrusions 232 (not shown). According to some embodiments presently disclosed, the support portion 125 comprises two protrusions 232 (not shown). According to some embodiments presently disclosed, the support portion 125 is bifurcated with a fastener hole 236 bored into the shaft 110. The bifurcated portion is configured to accommodate the first tab 221 of the selector member 215.

Figure 19A:
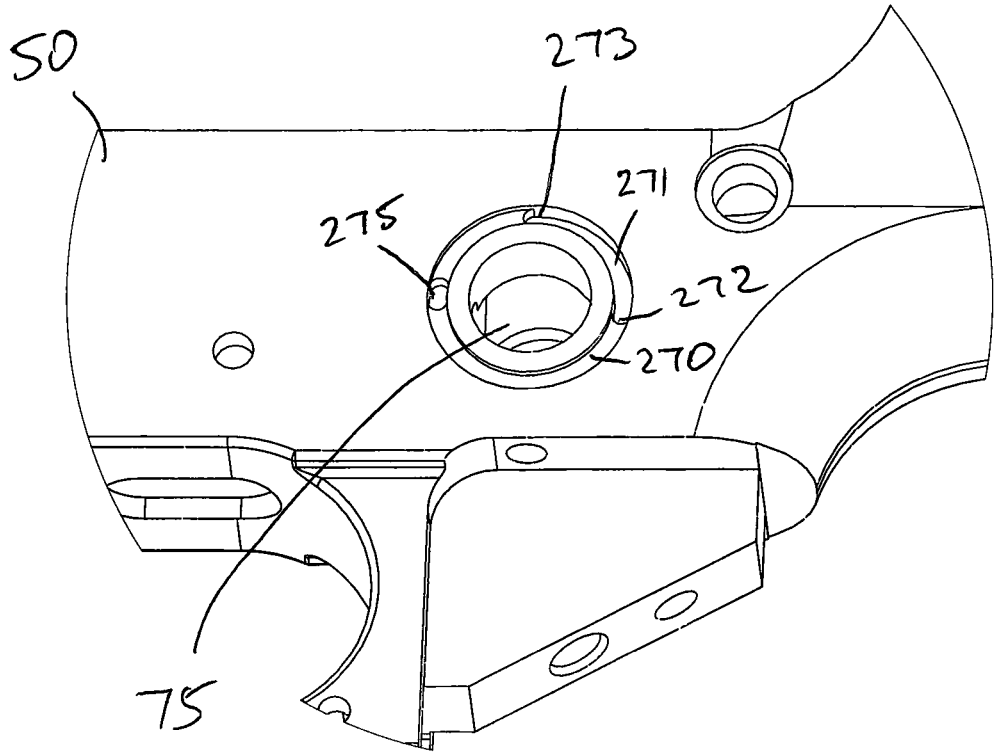
FIG. 19*a* depicts a closeup, angled view of a bore on the left side of the lower receiver according to some embodiments presently disclosed.
Figure 19B:
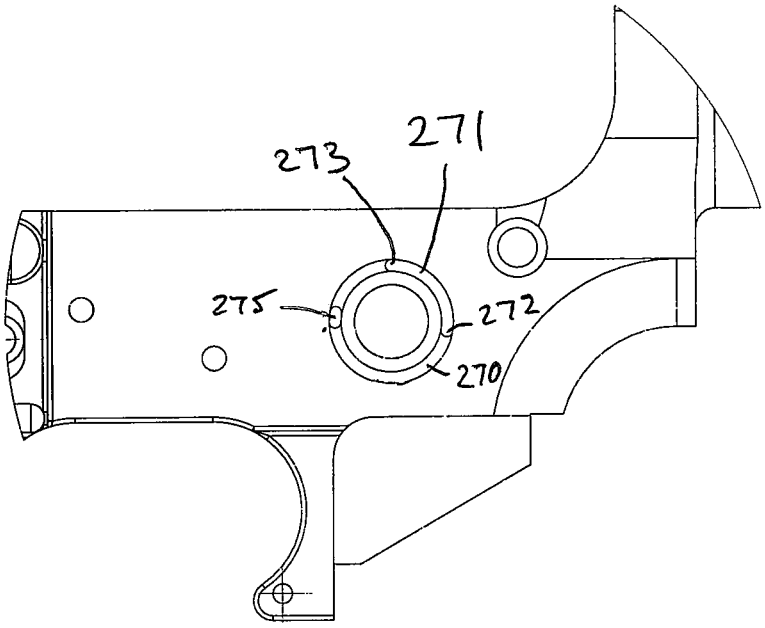
FIG. 19*b* depicts a closeup, side view of the bore on the left side of the lower receiver shown in FIG. 9*a*.

According to some embodiments presently disclosed, the lower receiver 50 comprises a first channel 270 around the bore 75 (shown in FIGS. 19*a-b*). According to some embodiments presently disclosed, the first channel 270 is configured to accommodate at least a portion of the selector member 215. According to some embodiments presently disclosed, the first channel 270 is configured to accommodate at least a portion of the rear edge 241 of the selector member 215. According to some embodiments presently disclosed, the first channel 270 is circular. According to some embodiments presently disclosed, the first channel 270 matches the shape of the selector member 215.

According to some embodiments presently disclosed, the lower receiver 50 comprises a second channel 271 (shown in FIGS. 19*a-b*). The second channel 271 may be positioned in the first channel 270 (shown in FIGS. 19*a-b*). The second channel 271 is configured to accommodate the second protrusion 222. The second protrusion 222 is free to move from first end 272 of the second channel 271 to the second end 273 of the second channel 271. According to some embodiments presently disclosed, when the second protrusion 222 is at the first end 272, the camming surface 120 is in a "SEMI-AUTOMATIC" position (shown in FIG. 20*a*). According to some embodiments presently disclosed, when the second protrusion 222 is at the second end 273, the camming surface 120 is in a "SAFE" position (shown in FIG. 20*b*).

According to some embodiments presently disclosed, the lower receiver 50 comprises a cavity 275 (shown in FIGS. 19*a-b*). The cavity 275 may be positioned in the first channel 270 (shown in FIGS. 19*a-b*). The cavity 275 is configured to accommodate the second protrusion 222. According to some embodiments presently disclosed, when the camming surface 120 is in a "SAFE" position (shown in FIG. 20*b*), the user can move the second protrusion 222 from the second channel 271 by pulling the selector member 215 against the force of the spring member 223 and away from the shaft 110 and rotating the second protrusion 222 towards the cavity 275. When the second protrusion 222 lines up with the cavity 275, releasing the selector member 215 will allow the force of the spring member 223 to lock the second protrusion 222 in the cavity 275. According to some embodiments presently disclosed, when the second protrusion 222 is at the cavity 275, the selector member 215 is in the "LOCKED" position while the camming surface 120 remains in a "SAFE" position (shown in FIG. 20*c*).

According to some embodiments presently disclosed, the camming surface 120 cannot be positioned in the "SEMI-AUTOMATIC" position without releasing the second protrusion 222 from the cavity 275. To release the second protrusion 222 from the cavity 275, the user needs to position the second protrusion 222 in the second channel 271 by pulling the selector member 215 against the force of the spring member 223 and away from the shaft 110 and rotating the second protrusion 222 towards the second channel 271. When the second protrusion 222 lines up with the second channel 271, releasing the selector member 215 will allow the force of the spring member 223 to position the second protrusion 222 in the second channel 271. The act of pulling and rotating the selector member 215 from the "LOCKED" position is configured to be a difficult task for children to accomplish thereby preventing them from firing the firearm.

Figure 20A:
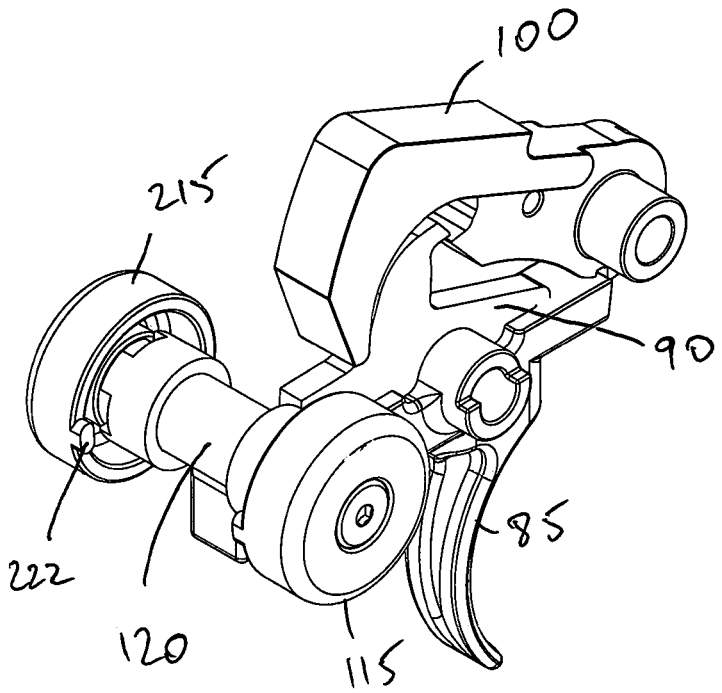
FIG. 20*a* depicts a perspective view of the selector member of the fire control assembly in a "SEMI-AUTOMATIC" position.
Figure 20B:
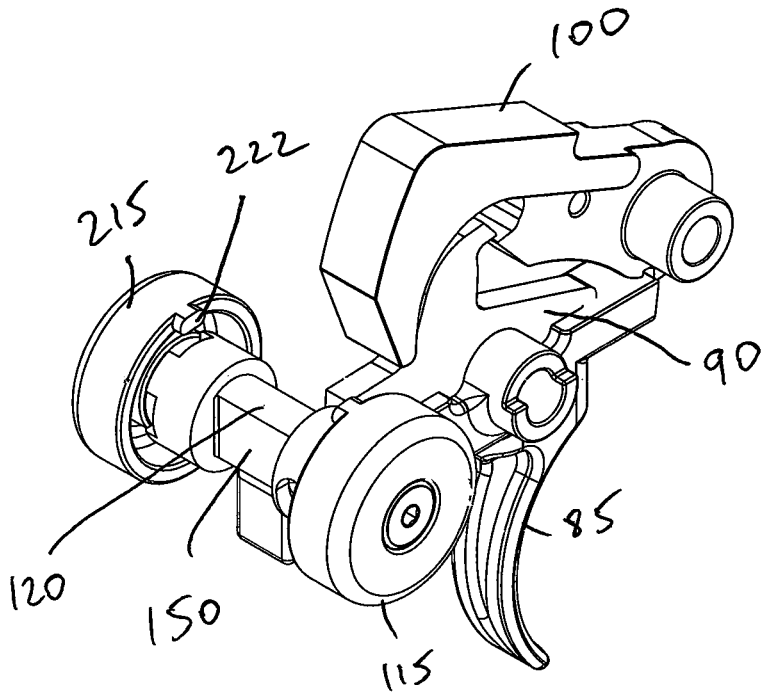
FIG. 20*b* depicts a perspective view of the selector member of the fire control assembly in a "SAFE" position.

Referring to FIG. 20*a*, there is shown a partial side elevation view of the firing mechanism 80 with the selector member 215 in the "SEMI-AUTOMATIC" position. Referring also to FIG. 20*b*, there is shown a partial side elevation view of the firing mechanism 80 with the selector member 215 in the "SAFE" position. Referring also to FIG. 20*b*, while the selector member 215 is in the "SAFE" position, the selector member 115 is also in the "SAFE" position. It is to be understood that while the selector member 215 is in the "SAFE" position, the selector member 115 may be in the "SAFE" position or "LOCKED" position.

Figure 20C:
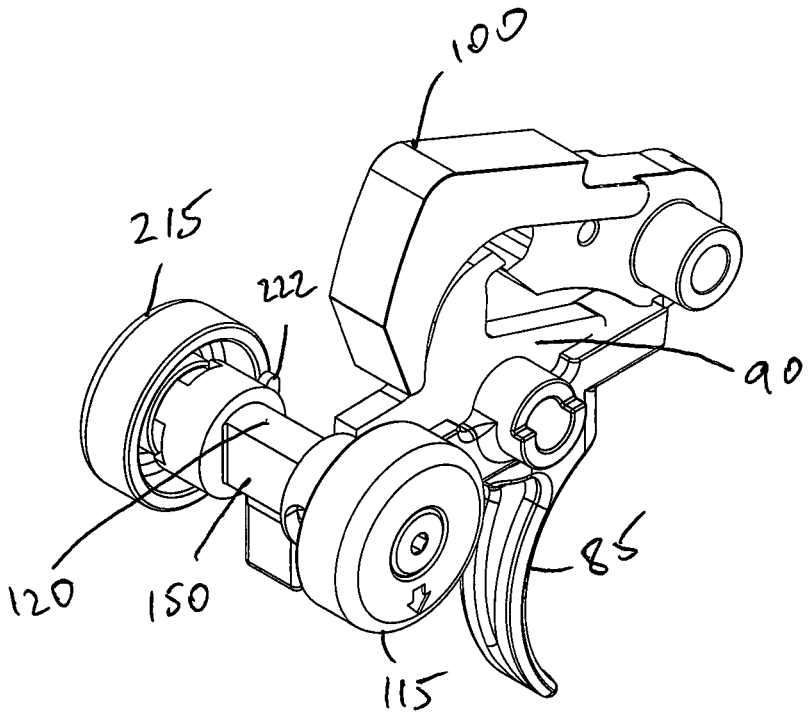
FIG. 20*c* depicts a perspective view of the selector member of the fire control assembly in a "LOCKED" position.

Referring also to FIG. 20*c*, there is shown a partial side elevation view of the firing mechanism 80 with the selector member 215 in the "LOCKED" position. It is to be understood that while the selector member 215 is in the "LOCKED" position, the selector member 115 may be in the "SAFE" position or "LOCKED" position. With the selector member 115 and/or the selector member 215 in the "LOCKED" position, the child is prevented from rotating the camming surface 120 to "SEMI-AUTOMATIC" position.

Figure 21A:
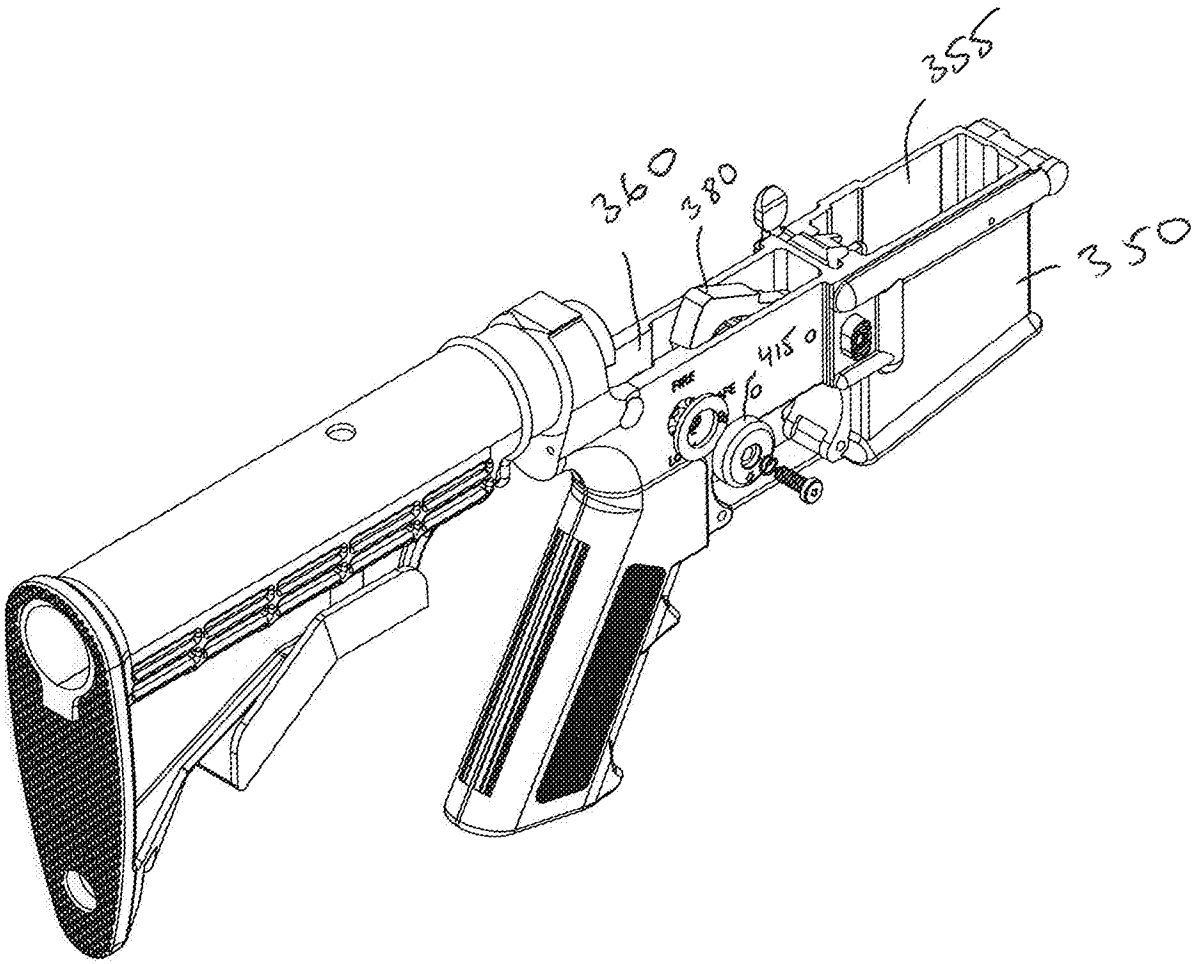
FIG. 21*a* depicts a right side of another partially assembled lower receiver according to some embodiments presently disclosed.
Figure 21B:
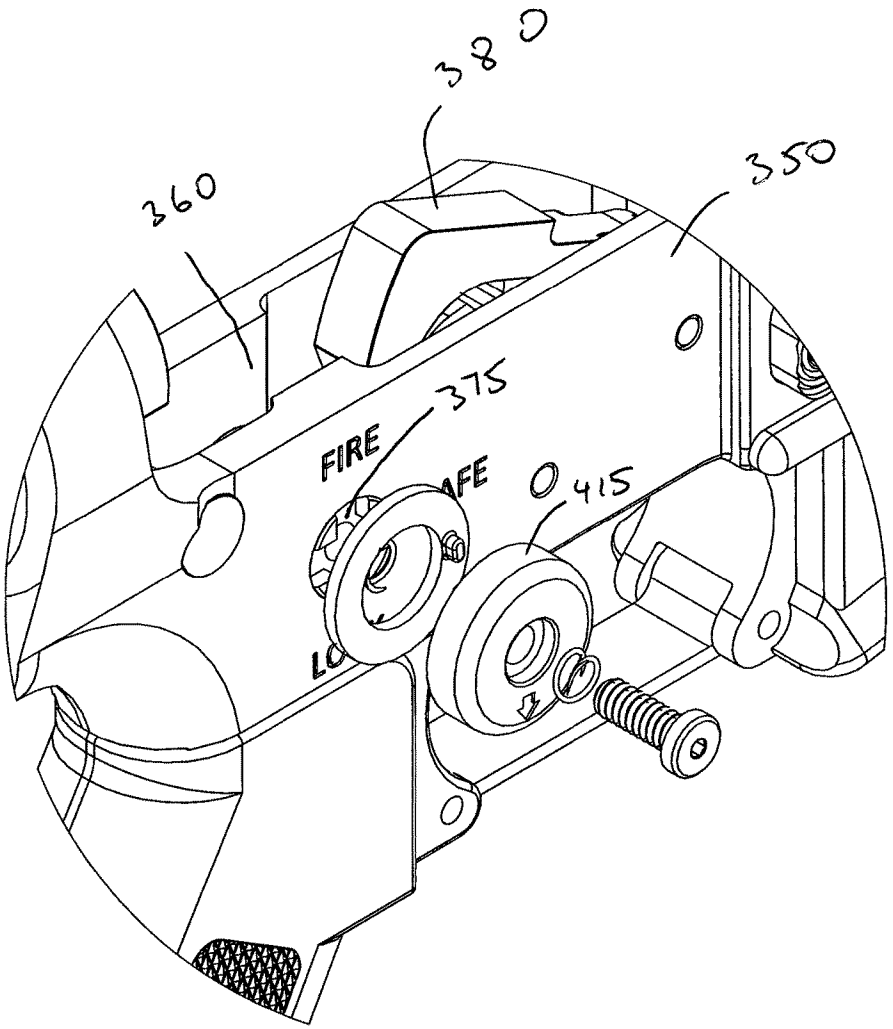
FIG. 21*b* depicts a magnified view of the lower receiver shown in FIG. 21*a*.

Referring to FIGS. 21*a-b*, there is shown, another lower receiver 350 of a firearm in accordance with some embodiments presently disclosed. According to some embodiments presently disclosed, the lower receiver 350 comprises openings for accepting the internal mechanisms required to operate the firearm. For example, the lower receiver 350 may comprise a magazine well 355 adapted to receive and hold an ammunition magazine (not shown). The lower receiver 350 may also comprise an opening 360 configured to accommodate a firing mechanism 380.

The firing mechanism 380 is capable of operation at least in a SEMI-AUTOMATIC mode. The firing mechanism 380 may also be placed in a SAFE mode. The lower receiver 350 has a fire control assembly 370 (shown in FIGS. 22*a-b*) allowing a user to select the mode of operation of the firing mechanism 380. The fire control assembly 370 is provided in bore 375 (shown in FIG. 21*b*) of lower receiver 350 with a detent (not shown) and detent spring (not shown). According to some embodiments, the bore 375 (shown in FIG. 21*b*) is the same as the bore 75 shown in FIGS. 3*a-b* and described above.

Figure 22A:
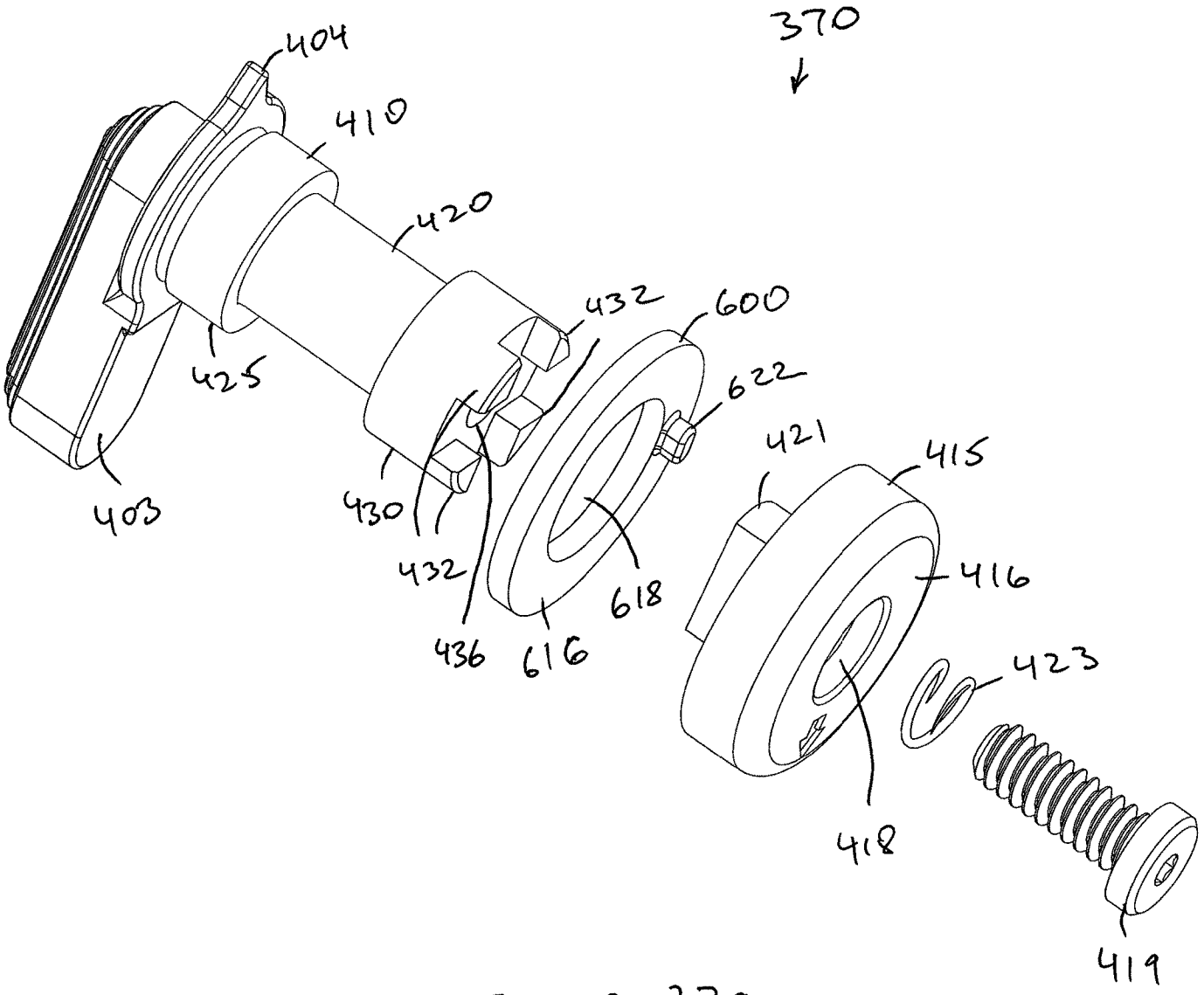
FIG. 22*a* depicts an exploded view of a fire control assembly according to some embodiments presently disclosed.
Figure 22B:
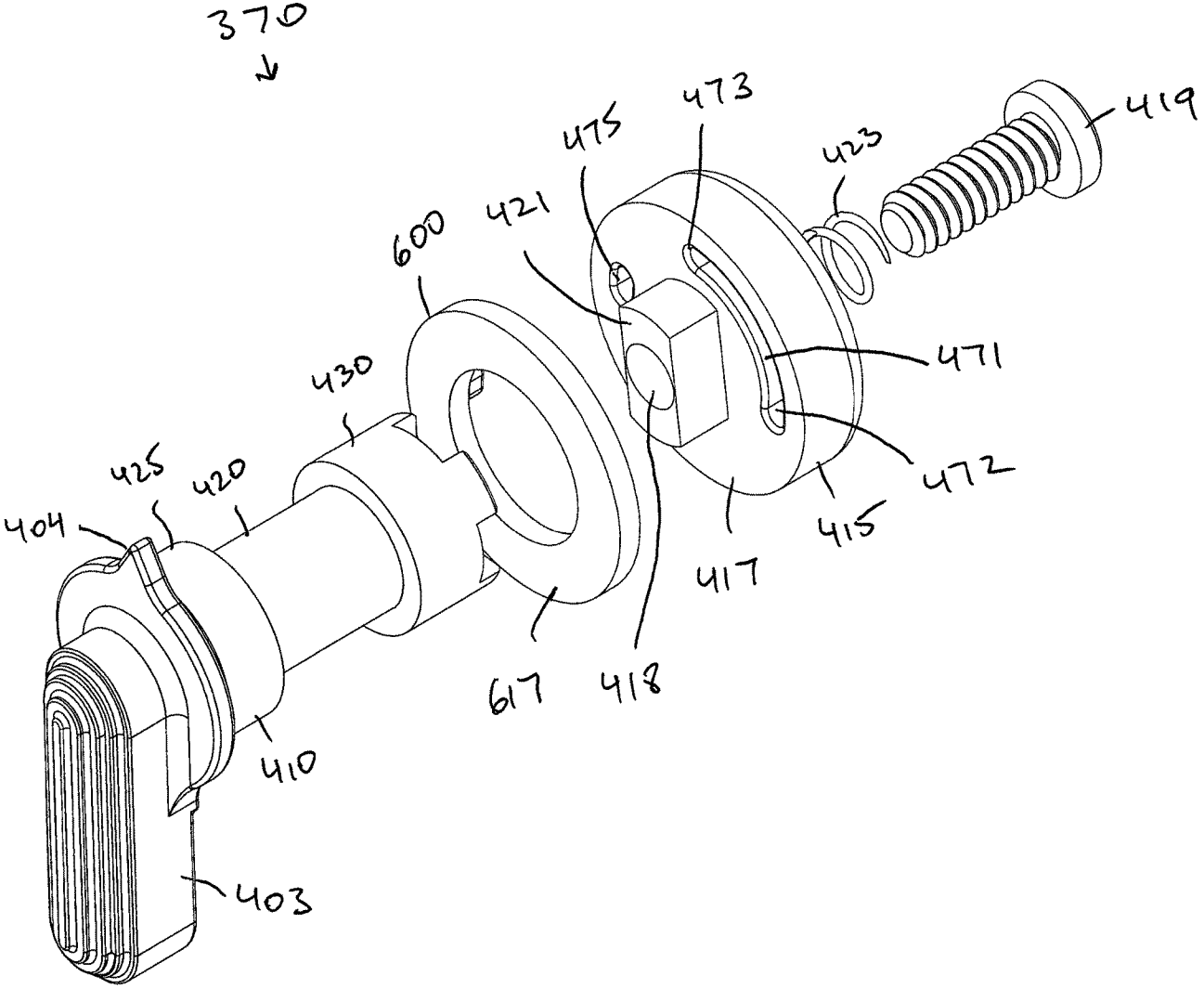
FIG. 22*b* depicts another exploded view of the fire control assembly shown in FIG. 22*a*.

Referring now to FIGS. 22*a-b*, there is shown an exploded view of the fire control assembly 370 according to some embodiments presently disclosed. According to some embodiments presently disclosed, the fire control assembly 370 has a pivotable shaft 410, a locking member 600 and a selector member 415.

According to some embodiments presently disclosed, the locking member 600 comprises a front surface 616 (shown in FIG. 22*a*) positioned away from the lower receiver 350 and a rear surface 617 (shown in FIG. 22*b*) positioned adjacent with the lower receiver 350. According to some embodiments presently disclosed, the rear surface 617 is configured to abut a portion of the lower receiver 350. According to some embodiments presently disclosed, the rear surface 617 is coupled with the lower receiver 350. According to some embodiments presently disclosed, the rear surface 617 is removably coupled with the lower receiver 350. According to some embodiments presently disclosed, the rear surface 617 is permanently coupled with the lower receiver 350. According to some embodiments presently disclosed, the locking member 600 is formed as part of the lower receiver 350.

According to some embodiments presently disclosed, the locking member 600 comprises a through aperture 618 configured to accommodate the pivotable shaft 410. According to some embodiments presently disclosed, the locking member 600 comprises a through aperture 618 configured to accommodate a first tab (i.e. first protrusion) 421 (shown in FIGS. 22*a-b*) and described in more detail below. The locking member 600 further comprises a protrusion 622 (shown in FIG. 22*a*) extending towards the selector member 415. According to some embodiments presently disclosed, the protrusion 622 extends from the front surface 616. According to some embodiments presently disclosed, the protrusion 622 extends from the lower receiver 350.

According to some embodiments presently disclosed, the shaft 410 comprises a camming portion or surface 420 and a support portion(s) 425, 430. Support portion(s) 425, 430 act as supporting surfaces and support the fire control assembly 370 in the bore 375 of lower receiver 350. The support portions 425, 430 may have a common diameter. The support portions 425, 430 may have different diameters. According to some embodiments presently disclosed, the shaft 410 is the same as the shaft 110 described above.

According to some embodiments presently disclosed, the selector member 415 comprises a front surface 416 (shown in FIG. 22*a*) positioned away from the lower receiver 350 and a rear surface 417 (shown in FIG. 22*b*) positioned adjacent with the lower receiver 350. According to some embodiments presently disclosed, the selector member 415 comprises a fastener through aperture 418 configured to accommodate a fastener 419. The fastener 419 may be a pin, a screw, a set screw, a full dog point set screw, or a dogleg set screw. The selector member 415 further comprises the first tab (i.e. first protrusion) 421 (shown in FIGS. 22*a-b*) extending towards the lower receiver 350. According to some embodiments presently disclosed, the first tab 421 extends from the rear surface 417. According to some embodiments presently disclosed, the selector member 415 is circular in shape.

According to some embodiments presently disclosed, the rear surface 417 of the selector member 415 comprises a channel 471 (shown in FIG. 22*b*). The channel 471 is configured to accommodate the protrusion 622. The selector member 415 is free to move/rotate about the fastener 419 until the protrusion 622 abuts the first end 472 of the channel 471 and/or abuts the second end 473 of the channel 471. According to some embodiments presently disclosed, when the protrusion 622 is at the first end 472, the camming surface 420 is in a "SEMI-AUTOMATIC" position. According to some embodiments presently disclosed, when the protrusion 622 is at the second end 473, the camming surface 420 is in a "SAFE" position.

According to some embodiments presently disclosed, the rear surface 417 of the selector member 415 comprises a cavity 475 (shown in FIG. 22*b*). The cavity 475 may be positioned adjacent to the channel 471 (shown in FIG. 22*b*). The cavity 475 is configured to accommodate the protrusion 622. According to some embodiments presently disclosed, when the camming surface 420 is in a "SAFE" position, the user can position the protrusion 622 in the cavity 475 by pulling the selector member 415 against the force of the spring member 423 and away from the shaft 410 and rotating the cavity 475 towards the protrusion 622. When the cavity 475 lines up with the protrusion 622, releasing the selector member 415 will allow the force of the spring member 423 to lock the protrusion 622 in the cavity 475. According to some embodiments presently disclosed, when the protrusion 622 is at the cavity 475, the selector member 415 is in the "LOCKED" position while the camming surface 420 remains in a "SAFE" position.

According to some embodiments presently disclosed, the camming surface 420 cannot be positioned in the "SEMI-AUTOMATIC" position without releasing the protrusion 622 from the cavity 475. To release the protrusion 622 from the cavity 475, the user needs to position the protrusion 622 in the channel 471 by pulling the selector member 415 against the force of the spring member 423 and away from the shaft 410 and rotating the channel 471 of the selector member 415 towards the protrusion 622. When the protrusion 622 lines up with the channel 471, releasing the selector member 415 will allow the force of the spring member 423 to position the protrusion 622 in the channel 471. The act of pulling and rotating the selector member 415 from the "LOCKED" position is configured to be a difficult task for children to accomplish thereby preventing them from firing the firearm.

According to some embodiments presently disclosed, the camming portion 420 of the fire control assembly 370 is a trigger camming surface 420. The shaft 410 having camming portion 420 may be cast of metal with the sections cast therein, however in alternate embodiments such sections or the part itself could be cut or machined in one part out of a billet of material if desired.

According to some embodiments presently disclosed, the support portion 430 comprises a plurality of protrusions 432 (shown in FIG. 22*a*) with a fastener aperture 436 bored into the shaft 410. The fastener aperture 436 is configured to accommodate the fastener 419. The protrusions 432 are separated so as to accommodate the first tab 421 of the selector member 415. According to some embodiments presently disclosed, the selector member 415 is coupled with the support portion 430 using the fastener 419 so as to position the first tab 421 between the protrusions 432. According to some embodiments presently disclosed, a spring member 423 may be positioned between the fastener 419 and the selector member 415. The spring member 423 urges the selector member 415 toward the shaft 410. According to some embodiments presently disclosed, the spring member 423 further allows the user to pull the selector member 415 against the force of the spring member 423 and away from the shaft 410 so as to reposition (i.e. reorient) the first tab 421 between the protrusions 432. According to some embodiments presently disclosed, the spring member 423 further allows the user to pull the selector member 415 against the force of the spring member 423 and away from the shaft 410 so as to reposition (i.e. reorient) the first tab 421 with respect to the protrusions 432.

According to some embodiments presently disclosed, the support portion 430 comprises four protrusions 432 as shown in FIG. 22*a*. According to some embodiments presently disclosed, the support portion 430 comprises three protrusions 432 (not shown). According to some embodiments presently disclosed, the support portion 130 comprises two protrusions 432 similar to the support portion 130 shown in FIG. 7. According to some embodiments presently disclosed, the support portion 430 is bifurcated 432 with a fastener hole 436 bored into the shaft 410. The bifurcated portion 432 is configured to accommodate the first tab 421 of the selector member 415.

According to some embodiments presently disclosed, the support portion 425 comprises an outer handle 403 (shown in FIGS. 22*a-b*). According to some embodiments presently disclosed, the outer handle 403 protrudes from the bore 375 of the lower receiver 350 when the fire control assembly 370 is positioned within the bore 375.

According to some embodiments presently disclosed, the outer handle 403 is shaped and positioned on the side of the lower receiver 350 to allow user operation (e.g. toggle) of the outer handle 403 with fingers (e.g. the thumb) on the same hand as that with which the user is pulling a trigger (i.e. the trigger hand). According to some embodiments presently disclosed, the outer handle 403 has an elongated tab shape and extends rearwards from the selector pivot axis and is rotated to effect selection of the fire control positions of the fire control assembly 370. In this embodiment, the fire control assembly 370 is capable of ambidextrous operation, and may be rotated using either the outer handle 403 or the selector member 415. The outer handle 403 of the fire control assembly 370 may have for example a pointer 404 or other suitable indicator that points to or otherwise indicates a indicated position that corresponds with the selected position of the fire control assembly 370.

According to some embodiments presently disclosed, the outer handle 403 is coupled with the support portion 425 using, for example, a fastener (not shown). According to some embodiments presently disclosed, the outer handle 403 extends from the support portion 425. According to some embodiments presently disclosed, the outer handle 403 is integral with the support portion 425.

According to some embodiments presently disclosed, the lower receiver 50 and/or 350 may be part of a firearm that is, for example, M-4, M-16 or AR15 type firearm. In alternate embodiments the firearm may be of any other suitable type. Although the present invention will be described with reference to the embodiments shown in the drawings, it should be understood that the present invention can be embodied in many alternate forms of embodiments. In addition, any suitable size, shape or type of elements or materials could be used. The lower receiver 50 and its sections, described above, is merely exemplary, and in alternate embodiments the lower receiver 50 may have other sections, portions or systems.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A fire control assembly comprising:

a pivotable shaft comprising a first end and a second end; and a first selector member removably coupled with the first end of the pivotable shaft;

wherein the first selector member is configured to move between three positions;

wherein the pivotable shaft is in a safe position when the first selector member is in the first position out of the three positions wherein the pivotable shaft is in a firing position when the first selector member is in the second position out of the three positions; and, wherein the pivotable shaft is in the safe position when the first selector member is in the third position out of the three positions.

2. The fire control assembly of claim 1, wherein the first selector member is movable between a first position relative to the pivotable shaft and a second position relative to the pivotable shaft;

wherein the first selector member is configured to rotate the pivotable shaft from the safe position to the firing position and back to the safe position when the first selector member is in the first position relative to the pivotable shaft;

wherein the first selector member is configured to prevent the pivotable shaft from rotating into the firing position when the first selector member is in the second position relative to the pivotable shaft.

3. The fire control assembly of claim 1, wherein the first end of the pivotable shaft comprises a plurality of protrusions, wherein the first selector member comprises a first protrusion extending from a side facing the pivotable shaft, wherein the plurality of protrusions of the pivotable shaft are spaced apart to accommodate the first protrusion extending from the first selector member.

4. The fire control assembly of claim 3, wherein the first selector member comprises a second protrusion extending from the side facing the pivotable shaft.

5. The fire control assembly of claim 1 further comprising:

a spring member; and a fastener;

wherein the first selector member is removably coupled with the first end of the pivotable shaft by the fastener;

wherein the spring member is positioned between the fastener and the first selector member.

6. The fire control assembly of claim 1 further comprising an outer handle coupled with the second end of the pivotable shaft.

7. The fire control assembly of claim 1 further comprising a second selector member removably coupled with the second end of the pivotable shaft.

8. The fire control assembly of claim 7, wherein the second selector member is movable between a first position relative to the pivotable shaft and a second position relative to the pivotable shaft; wherein the second selector member is configured to move the pivotable shaft from the safe position to the firing position and back to the safe position when the second selector member is in the first position relative to the pivotable shaft; wherein the second selector member is configured to prevent the pivotable shaft from moving into the firing position when the second selector member is in the second position relative to the pivotable shaft.

9. The fire control assembly of claim 7 further comprising:

another spring member; and another fastener;

wherein the second selector member is removably coupled with the second end of the pivotable shaft by the another fastener;

wherein the another spring member is positioned between the another fastener and the second selector member.

* * * * *